US006390592B2

(12) United States Patent
Okamura

(10) Patent No.: US 6,390,592 B2
(45) **Date of Patent: *May 21, 2002**

(54) INK JET RECORDING APPARATUS

(75) Inventor: Yoshitaka Okamura, Fukushima (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/382,602

(22) Filed: Aug. 25, 1999

(30) Foreign Application Priority Data

Aug. 28, 1998 (JP) ..... 10-243533

(51) Int. Cl.[7] ..... B41J 2/165
(52) U.S. Cl. ..... 347/29; 347/32
(58) Field of Search ..... 347/29, 30, 32, 347/33

(56) References Cited

U.S. PATENT DOCUMENTS

| | | | | |
|---|---|---|---|---|
| 5,115,250 A | * | 5/1992 | Harmon et al. | 347/33 |
| 5,627,574 A | * | 5/1997 | Fahy | 347/33 |
| 5,638,099 A | * | 6/1997 | Nguyen et al. | 347/22 |
| 5,790,148 A | * | 8/1998 | Gavillet et al. | 347/29 |
| 5,801,725 A | * | 9/1998 | Neese et al. | 347/32 |
| 5,847,728 A | * | 12/1998 | Lee | 347/33 |
| 5,914,735 A | | 6/1999 | Yamamoto et al. | 347/33 |
| 5,980,018 A | * | 11/1999 | Taylor et al. | 347/31 |
| 6,007,180 A | * | 12/1999 | Muraki | 347/32 |

FOREIGN PATENT DOCUMENTS

| | | |
|---|---|---|
| EP | 0 313 204 | 4/1989 |
| EP | 0 676 290 | 10/1995 |
| EP | 0 845 360 | 6/1998 |
| GB | 2 284 576 | 6/1995 |
| JP | 7-156419 | 6/1995 |

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

An ink jet recording apparatus mounts an ink jet recording head for discharging ink from an ink discharging port and has a carriage moved to a recording position opposed to a recording medium and a capping position opposed to a cap for covering the ink discharging port. The ink jet recording apparatus comprises a cap holder for holding the cap for covering the ink discharging port, a cap slider which holds the cap holder and a resilient member for resiliently biasing the cap to a side of the ink jet recording head in the capping position, and is moved in the same direction as a moving direction of the carriage together with the movement of the carriage in accordance with the movement of the carriage to the capping position, and a slider holding mechanism which movably supports the cap slider in the moving direction and has a mechanism for displacing the cap holder to the ink jet recording head side in the capping position in accordance with the movement of the cap slider.

7 Claims, 23 Drawing Sheets

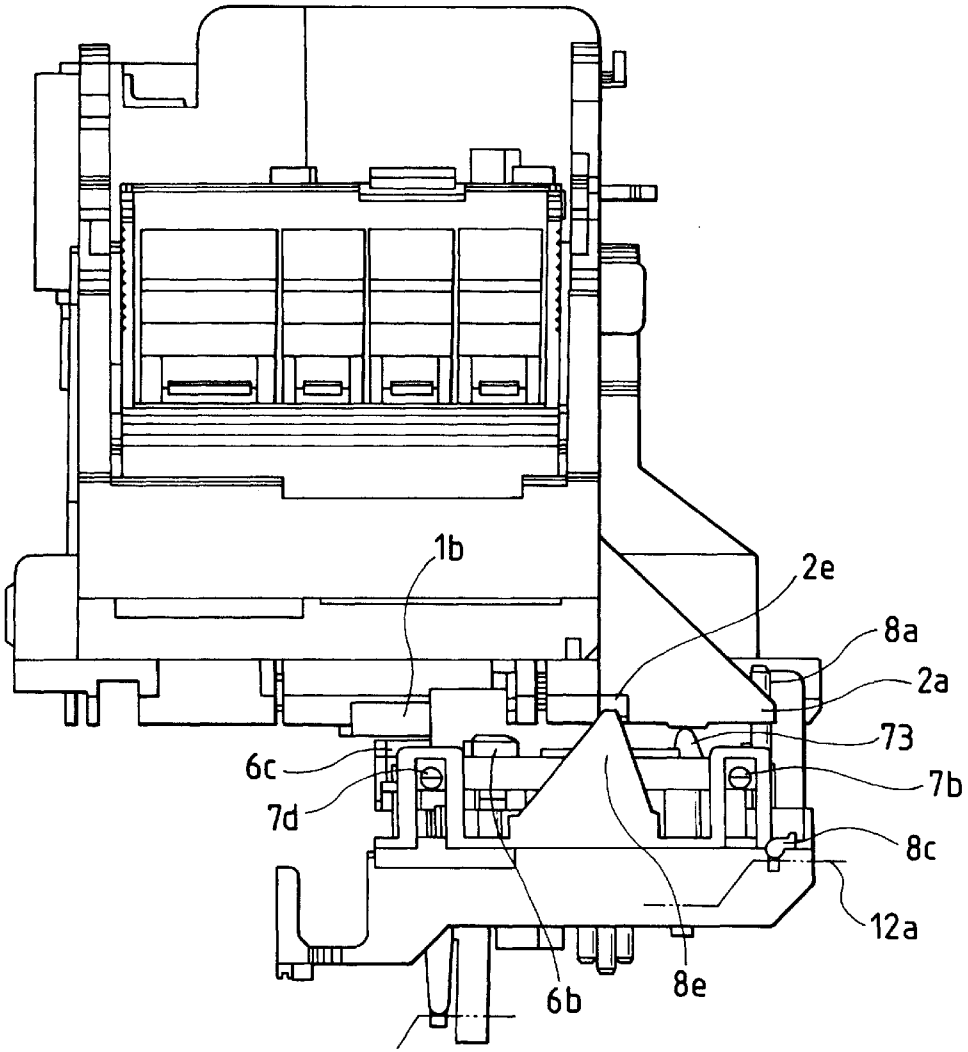
FIG. 23
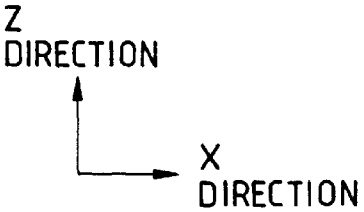

INK JET RECORDING APPARATUS

BACKGROUND OF THE INVENTION

1. Field of the Invention

The present invention relates to an ink jet recording apparatus for performing a recording operation by discharging ink. More particularly, the present invention relates to a capping mechanism for protecting a head of the ink jet recording apparatus.

2. Related Background Art

Capping means is conventionally required for the following reasons in the ink jet recording apparatus. Firstly, the capping means is required for so-called protection of a recording head such that drying of ink in a nozzle portion of the recording head is prevented and no foreign matters such as dust, etc. are attached to the nozzle during a standby operation of a recorder body. Secondly, the capping means is required as sucking means for restoring a so-called discharging state of the ink. In this restoration, the internal pressure of a cap is set to a negative pressure by separate pump means and the above foreign matters are sucked and removed in a state in which the cap comes in contact with the recording head to normally discharge the ink when the nozzle portion is clogged by the foreign matters such as dust, etc.

The capping mechanism is generally divided into two methods.

A first method utilizes the movement of a carriage mounting the recording head thereto. In a second method, the cap is operated by e.g., a paper conveying motor and a capping unit dedicated motor except for power of the carriage.

In the first method utilizing force caused by the movement of the carriage, a slide cap mechanism is used in many cases. In this slide cap mechanism, the carriage is engaged with a cap unit when the carriage reaches a capping position. The cap is moved toward the recording head by cam means simultaneously when the cap unit is slid together with the carriage. Thus, the cap is pressed against the recording head.

In the second method utilizing a motor, etc. except for power of the carriage, the operation of the cap is switched from a paper conveying state to a cap opening-closing state through a switching mechanism of this operation. Then, the carriage is moved to the capping position and the capping operation is performed. This construction is hereinafter called a motor drive capping mechanism.

However, the above motor drive capping mechanism performs an operation of the capping mechanism through the paper conveying motor or the dedicated motor. Therefore, the mechanism becomes complicated and it takes time to open and close the cap. Accordingly, a problem exists in that no throughput of print is improved when a printing operation is started from a capping state.

Further, since cost is also increased, the motor drive capping mechanism is adopted in a kind of a middle class device or more in price in many cases.

In contrast to this, the ink jet recording apparatus of the slide cap mechanism can be manufactured at low cost so that the slide cap mechanism is adopted in a device kind belonging to a spread price band in many cases.

However, in the device kind of this price band, there is also an ink jet recording apparatus with a recording head having magenta and cyan thin in density in addition to conventional four color inks (black, yellow, magenta, cyan) to print a high quality image at a photograph level in recent years. Further, there is also a recorder in which two heads can be mounted to one carriage so as to perform a high speed printing operation.

However, in the ink jet recording apparatus having two heads mounted to one carriage, a corresponding cap must come in contact with a forming face of an ink discharging port of each of the heads, or must be closely attached to this forming face.

There is an ink jet type recorder described in Japanese Patent Laid-Open Application No. 7-156419 as one example of the disclosure of such a capping mechanism. In this recorder, (1) first and second cap members seal nozzle openings of first and second ink jet recording heads directed downward and are arranged on an upper face of a slider, and this slider is rotatably arranged around a rotating shaft perpendicular to the moving direction of a carriage arranged in a central portion of the slider and is supported by a supporting member vertically moved in accordance with the movement of the carriage. (2) A The slider is rotated around the rotating shaft by moving the carriage so that a seesaw movement of the slider is made. (3) The slider is resiliently biased on a side of the ink jet recording head with respect to the recorder so that two cap members are sequentially fitted to the ink jet recording heads. Thus, capping of each of the ink jet recording heads corresponding to the plural caps is performed by a single equalizing mechanism.

However, in the construction for rotating the plural caps around one rotating shaft and arranging the plural caps in the slider making the seesaw movement, there was a case in which all the forming faces could not be necessarily precisely capped in accordance with a mounting state of the ink jet recording head to the carriage and a dispersion in manufacture of each of constructional members of the ink jet recording head, etc. Further, as the number of ink jet recording heads is increased, the equalizing mechanism of the cap slider becomes complicated. Furthermore, a problem also exists in that capping accuracy is reduced and manufacturing cost is increased.

SUMMARY OF THE INVENTION

An object of the present invention is to provide an ink jet recording apparatus having a simple construction and able to position a cap covering an ink discharging port of an ink jet recording head or protecting the ink jet recording head with high accuracy with respect to the ink jet recording head.

Another object of the present invention is to provide an ink jet recording apparatus having a simple construction and a capping mechanism with respect to the ink jet recording head able to reliably cover the ink discharging port of the ink jet recording head or reliably protect the ink jet recording head.

Another object of the present invention is to provide an ink jet recording apparatus which mounts an ink jet recording head for discharging ink from an ink discharging port and has a carriage moved to a recording position opposed to a recording medium and a capping position opposed to a cap for covering the ink discharging port, the ink jet recording apparatus comprising: a cap holder for holding the cap for covering the ink discharging port; a cap slider which holds the cap holder and a resilient member for resiliently biasing the cap to a side of the ink jet recording head in the capping position, and is moved in the same direction as a moving direction of the carriage together with the movement of the carriage in accordance with the movement of the carriage to the capping position; and a slider holding mechanism which movably supports the cap slider in the moving direction and has a mechanism for displacing the cap holder to the ink jet recording head side in the capping position in accordance with the movement of the cap slider.

Another object of the present invention is to provide an ink jet recording apparatus able to simultaneously mount plural recording heads to a carriage and performing a recording operation by discharging ink, the apparatus comprising: a plurality of caps for protecting nozzles of the respective recording heads; a cap holder for holding the plural caps; a cap slider for holding the cap holder and slid by contact with the carriage; and a cam face for moving the cap slider toward each of the recording heads in a capping position, wherein the cap holder and the cap slider are fitted to each other in a scanning direction of the carriage; and the cap slider has a first positioning member hitting against the carriage in the scanning direction of the carriage; and the first positioning member is fitted to the cap holder and positions the cap holder and the cap slider in the scanning direction of the carriage, the cap-slider further has a second positioning member; and the second positioning member positions the cap holder and the cap slider in a direction different from the scanning direction of the carriage; and the second positioning member is fitted to the carriage in the capping position and positions the carriage and the caps, and the caps are further arranged in the vicinity of the first and second positioning members on the cap holder; and the cap holder is pressurized by a spring approximately from just below the caps to press the caps against the recording heads in the capping position.

Another object of the present invention is to provide an ink jet recording apparatus constructed such that recording heads on a carriage can be exchanged in accordance with a using object, the ink jet recording apparatus comprising: a plurality of caps for protecting nozzles of the respective recording heads; a cap holder for holding the plural caps; a cap slider for holding the cap holder and slid by contact with the carriage; and a cam face for moving the cap slider toward each of the recording heads in a capping position, wherein the cap holder and the cap slider are fitted to each other in a scanning direction of the carriage; and the cap slider has a first positioning member hitting against the carriage in the scanning direction of the carriage and also has a third positioning member hitting against the carriage in a vertical direction with respect to a sheet face of recording paper; and the first positioning member is fitted to the cap holder and positions the cap holder and the cap slider in the scanning direction of the carriage, the cap slider further has a second positioning member; and the second positioning member positions the cap holder and the cap slider in a direction different from the scanning direction of the carriage; and the second positioning member is fitted to the carriage in the capping position and positions the carriage and the caps, and the cap holder is further pressurized by springs approximately from just below the third positioning member and approximately from just below the caps according to the recording heads to press the caps against the recording heads in the capping position.

BRIEF DESCRIPTION OF THE DRAWINGS

FIG. 23 is a side view of the cap of the slide cap mechanism of the ink jet recording apparatus in the second embodiment of the present invention when the cap comes in contact with the black head (or the photohead) of the carriage.

DETAILED DESCRIPTION OF THE PREFERRED EMBODIMENTS

The embodiments of the present invention will next be explained with reference to the drawings.

First embodiment

Figure 1:
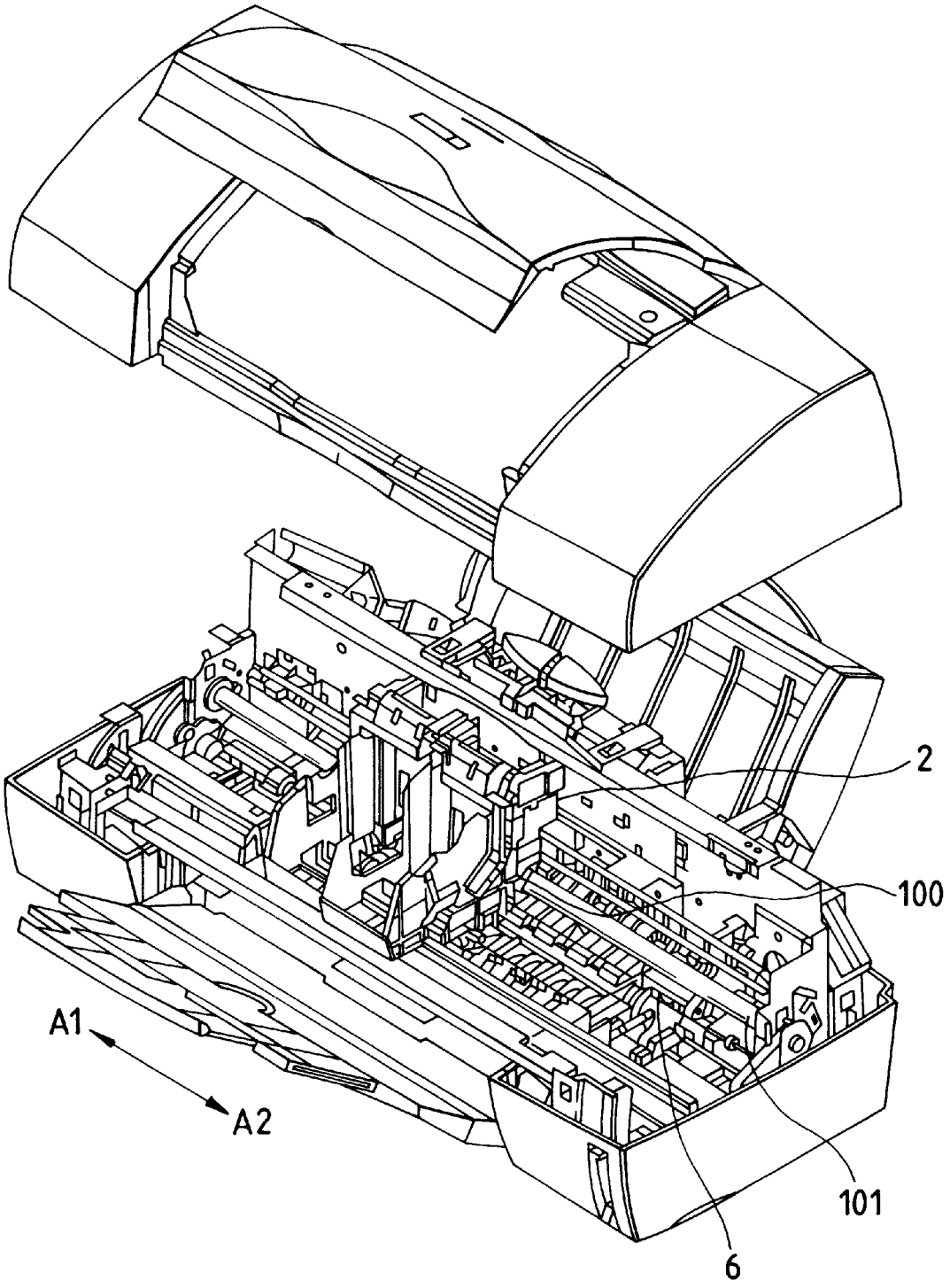
FIG. 1 is a perspective view showing an ink jet recording apparatus in a first embodiment of the present invention.
Figure 2:
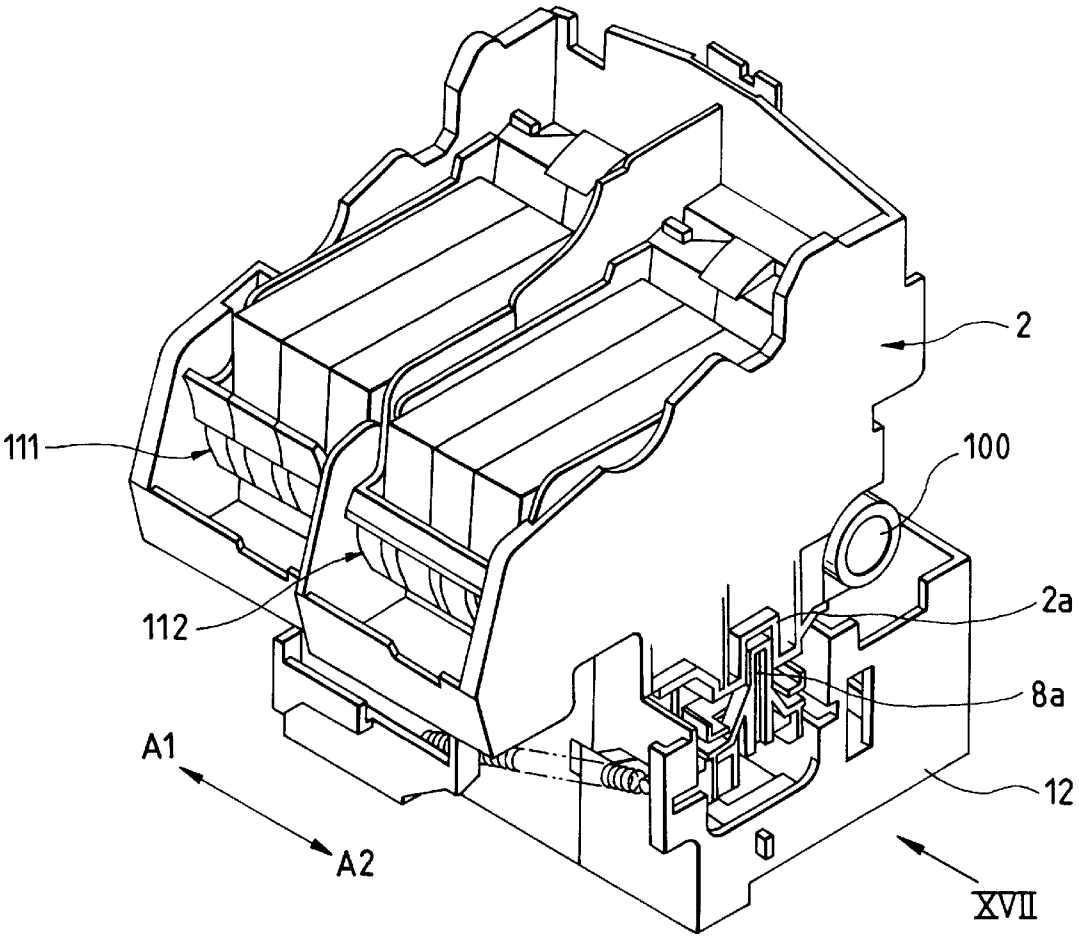
FIG. 2 is a perspective view showing a carriage and a slide cap mechanism in the ink jet recording apparatus in the first embodiment of the present invention.
Figure 3:
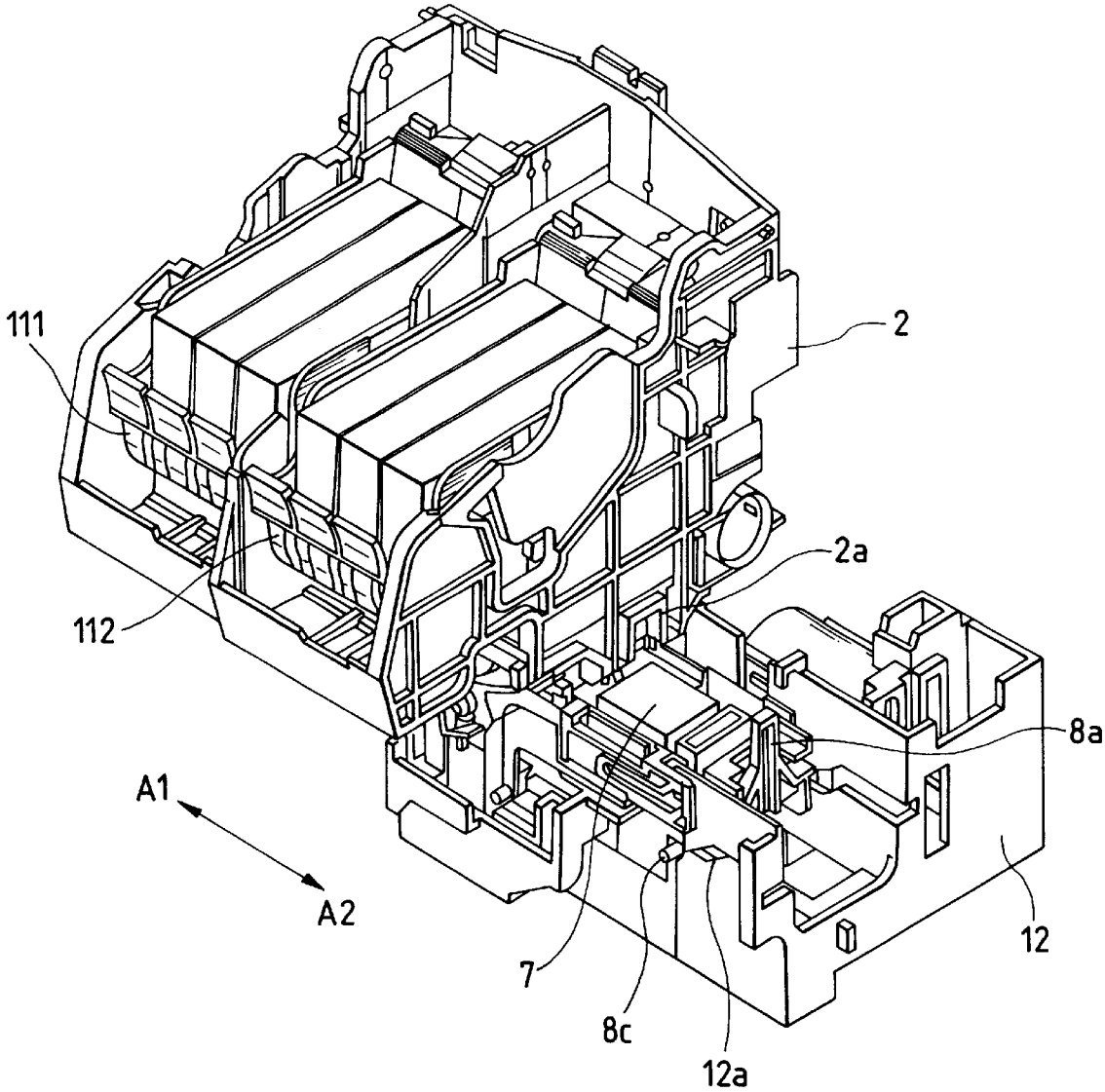
FIG. 3 is a perspective view showing the carriage and the slide cap mechanism in the ink jet. recording apparatus in the first embodiment of the present invention.

FIGS. 1 to 3 show perspective views of an ink jet recording apparatus in a first embodiment of the present invention. In these figures, a carriage 2 is freely moved along a guide shaft 101 in a direction different from the conveying direction of a recording medium, e.g., in a main scanning direction perpendicular to the conveying direction. The carriage 2 is attached by inserting the guide shaft 101 into a hole 100 of a carriage rear portion. Two heads of different kinds are mounted to the carriage 2 and are shifted from each other, e.g., by about 4 mm in the conveying direction of a sheet of recording paper as the recording medium. The two heads are constructed by a photohead 111 having tanks of magenta and cyan thin in density and a black ink tank, and a color head 112 able to discharge yellow, magenta and cyan inks. The recorder performs a printing operation by six color inks obtained by combining these colors with each other so that an image of high quality at a photograph level can be clearly printed. Otherwise, a text can be printed at high speed and a business color can be printed at high speed by replacing the photohead 111 with a black head 111*a* having only the black ink tank.

The ink jet recording apparatus has a capping position and has a slide cap mechanism. When the carriage 2 is located in this capping position, the slide cap mechanism performs capping (caps a forming face of an ink discharging port of each head and covers the ink discharging port) to perform restoring processing of ink discharging performance with respect to the two heads mounted to the carriage 2 or protect the heads.

Next, the constructions of a head peripheral portion and a suction pump for setting the internal pressure of a cap coming in contact with each head to a negative pressure in the capping of the two heads of the carriage 2 using the slide cap mechanism will be explained with reference to FIGS. 4 to 9.

Figure 4:
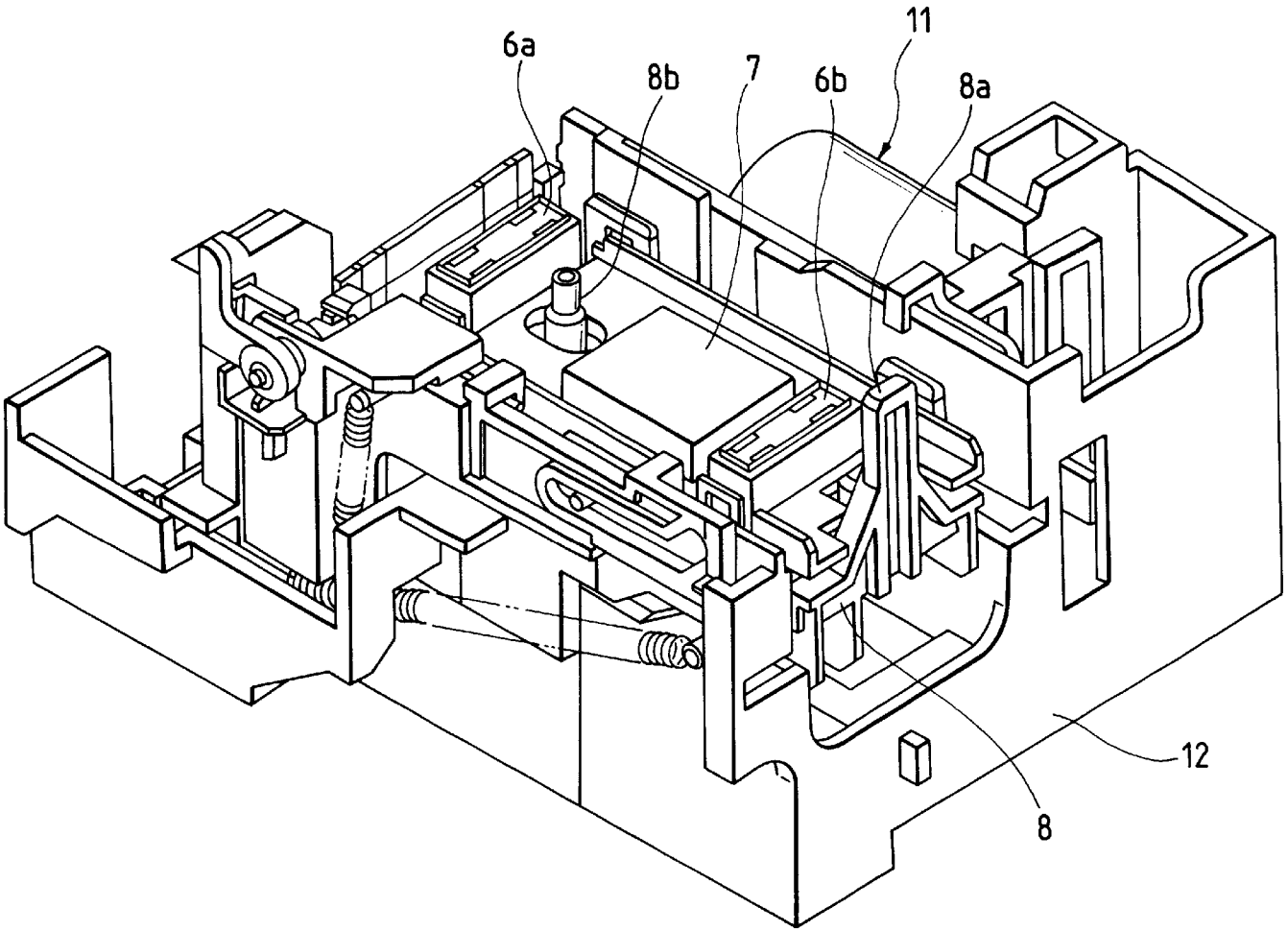
FIG. 4 is a perspective view showing a pump section and the slide cap mechanism in the ink jet recording apparatus in the first embodiment of the present invention.
Figure 5:
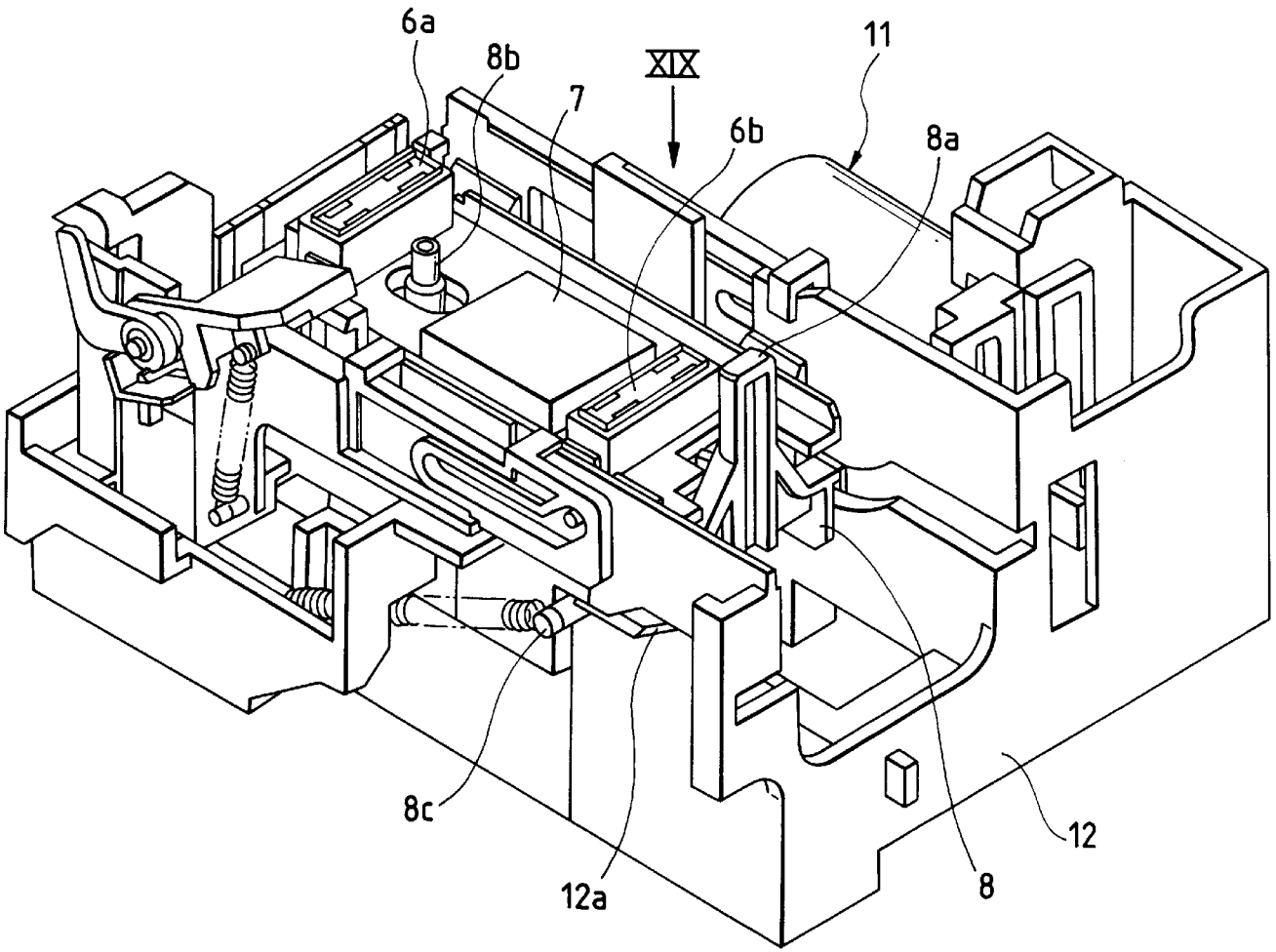
FIG. 5 is a perspective view showing the pump section and the slide cap mechanism in the ink jet recording apparatus in the first embodiment of the present invention.

FIGS. 4 and 5 show perspective views of the cap and the suction pump. The suction pump 11 shown in these figures has roller holders in two systems and a predetermined recording head is restored or protected such that suction tubes of the respective systems of caps 6*a*, 6*b* are pulled and flattened in accordance with a rotating direction of the pump.

Figure 6:
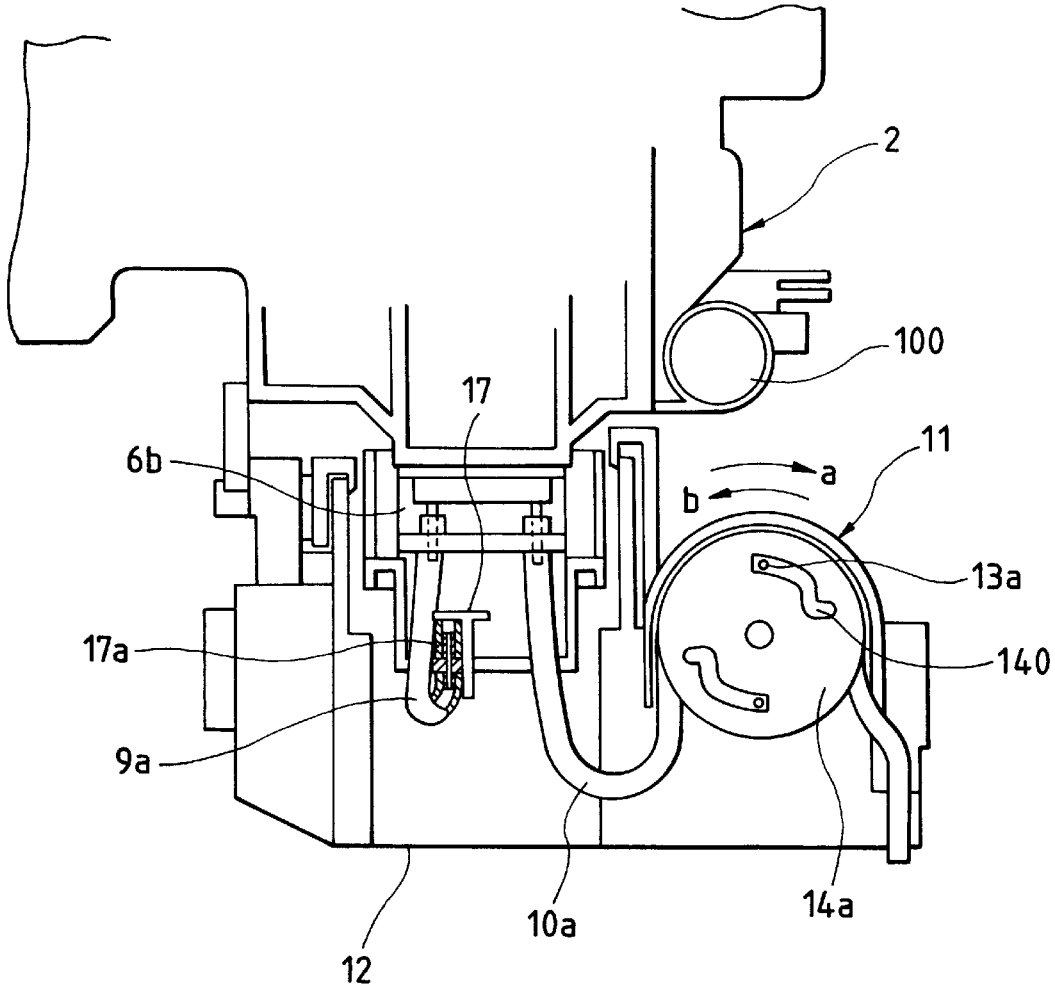
FIG. 6 is a cross-sectional view showing the carriage and the pump section in the ink jet recording apparatus in the first embodiment of the present invention.
Figure 7:
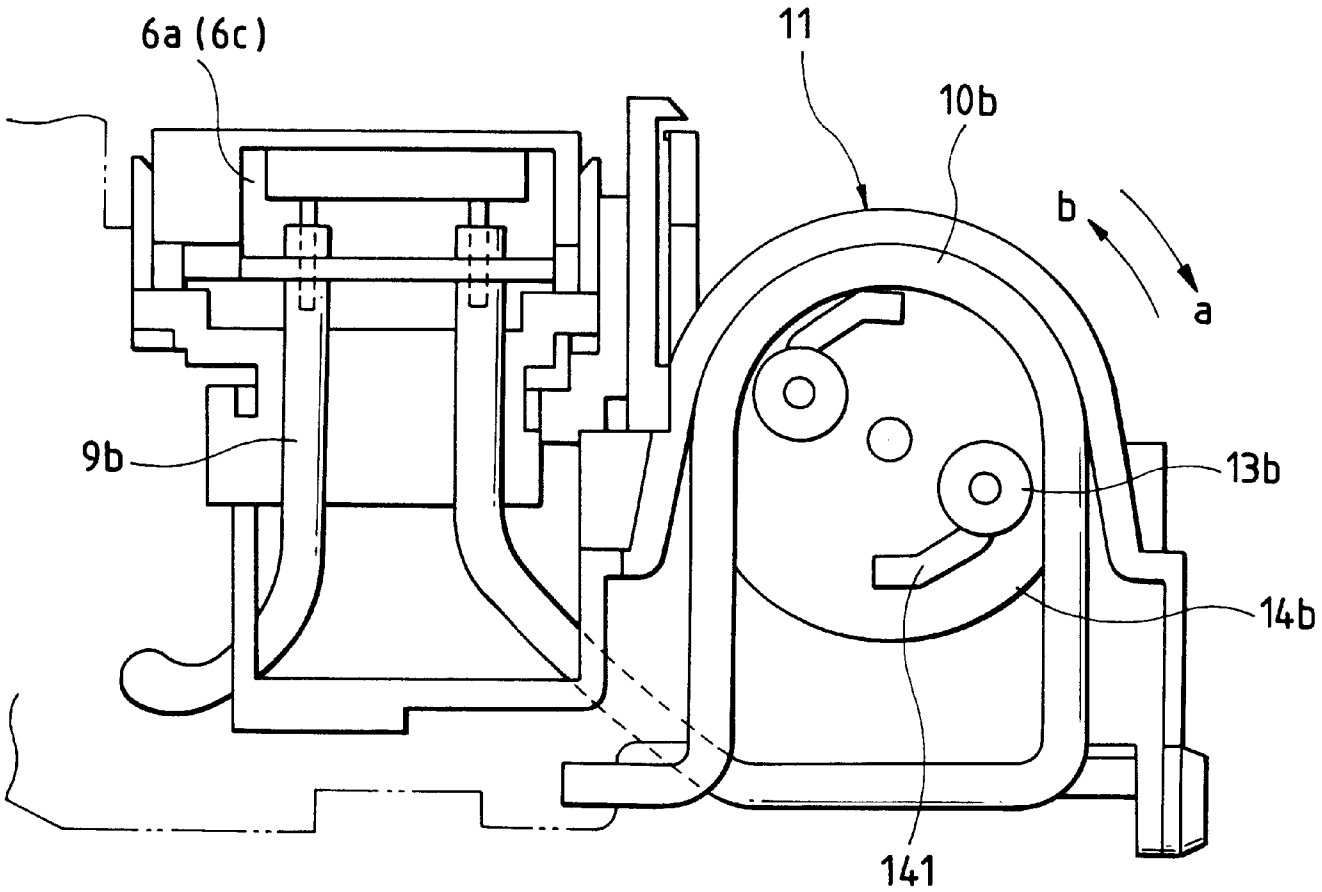
FIG. 7 is a cross-sectional view showing the carriage and the pump section in the ink jet recording apparatus in the first embodiment of the present invention.
Figure 8:
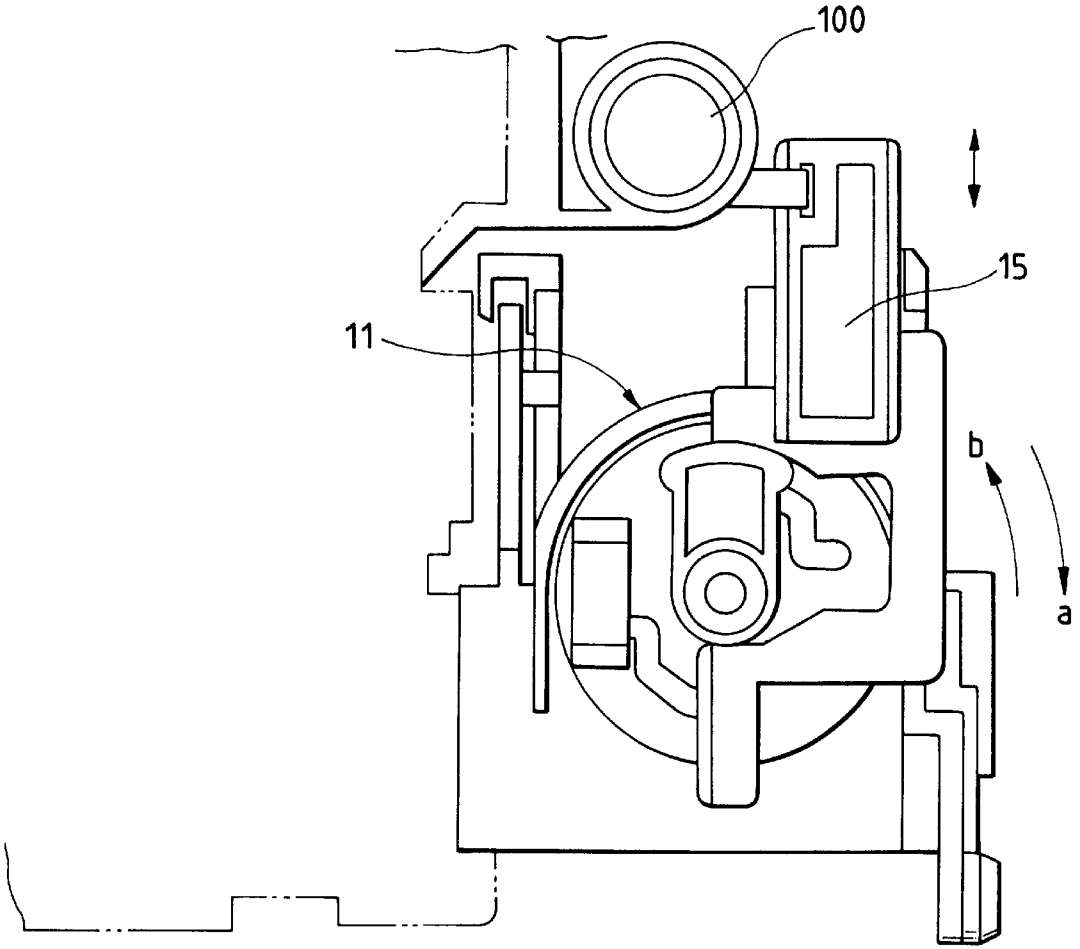
FIG. 8 is a cross-sectional view showing a lock means of the carriage of the ink jet recording apparatus in the first embodiment of the present invention.
Figure 9:
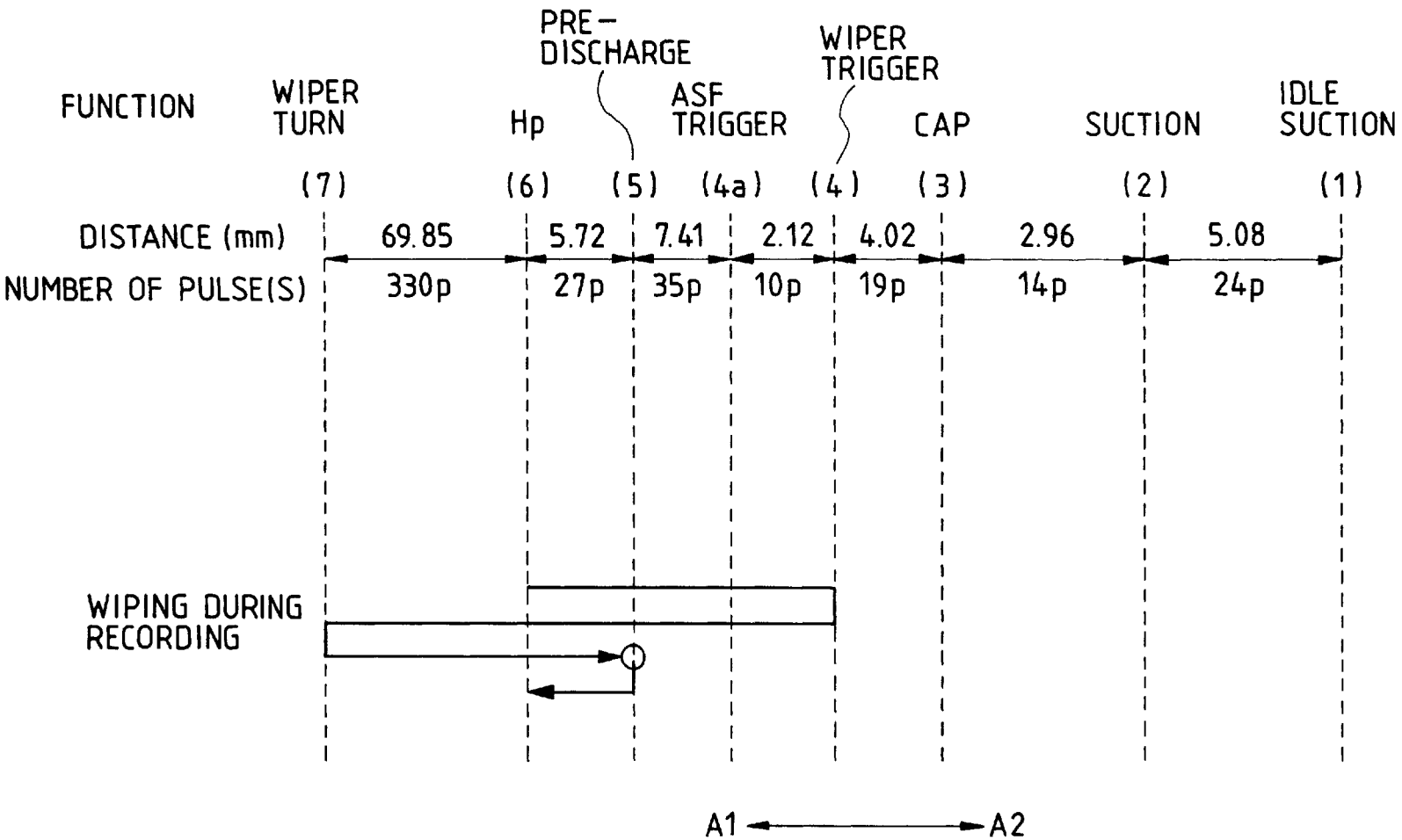
FIG. 9 is a phase diagram of the carriage of the ink jet recording apparatus in the first embodiment of the present invention.

FIGS. 6 to 8 show cross-sectional views of a suction pump section. When a roller holder 14*a* is rotated in the direction of an arrow a in FIG. 6, a suction roller 13*a* is moved along a cam 140 of the roller holder 14*a*, and a suction tube 10*a* arranged between a restoring base 12 and the suction roller 13*a* is pulled and flattened so that a negative pressure is caused within the cap 6*b*. At this time, since the roller holder 14*b* is rotated in the direction of an arrow a in FIG. 7, the suction roller 13*b* is moved along a cam 141 of the roller holder 14*b* and reaches a position in which no suction tube 10*b* is closed in a radial direction. Accordingly, the interior of the cap 6*a* communicated with the suction tube 10*b* is communicated with the atmosphere.

Conversely, when the roller holder 14*b* is rotated in the direction of an arrow b in FIG. 7, the suction roller 13*b* is moved along the cam 141 of the roller holder 14*b*, and the air is extracted from the suction tube 10*b* arranged between the restoring base 12 and the suction roller 13*b* so that a negative pressure is caused within the cap 6*a* communicated with the suction tube 10*b*. At this time, since the roller holder 14*a* is rotated in the direction of an arrow b in FIG. 6, the suction roller 13*a* is moved along the cam 140 of the roller holder 14*a* and reaches a position in which no suction tube 10*a* is closed in the radial direction. Accordingly, the interior of the cap 6*a* communicated with the suction tube 10*a* is communicated with the atmosphere.

A carriage lock 15 is frictionally operated such that the carriage lock 15 attains a lock state at a normal rotating time of the suction pump 11 (in the direction of an arrow b in FIG. 8) and attains an unlock state at a reverse rotating time (in the direction of an arrow a in FIG. 8).

Figure 11:
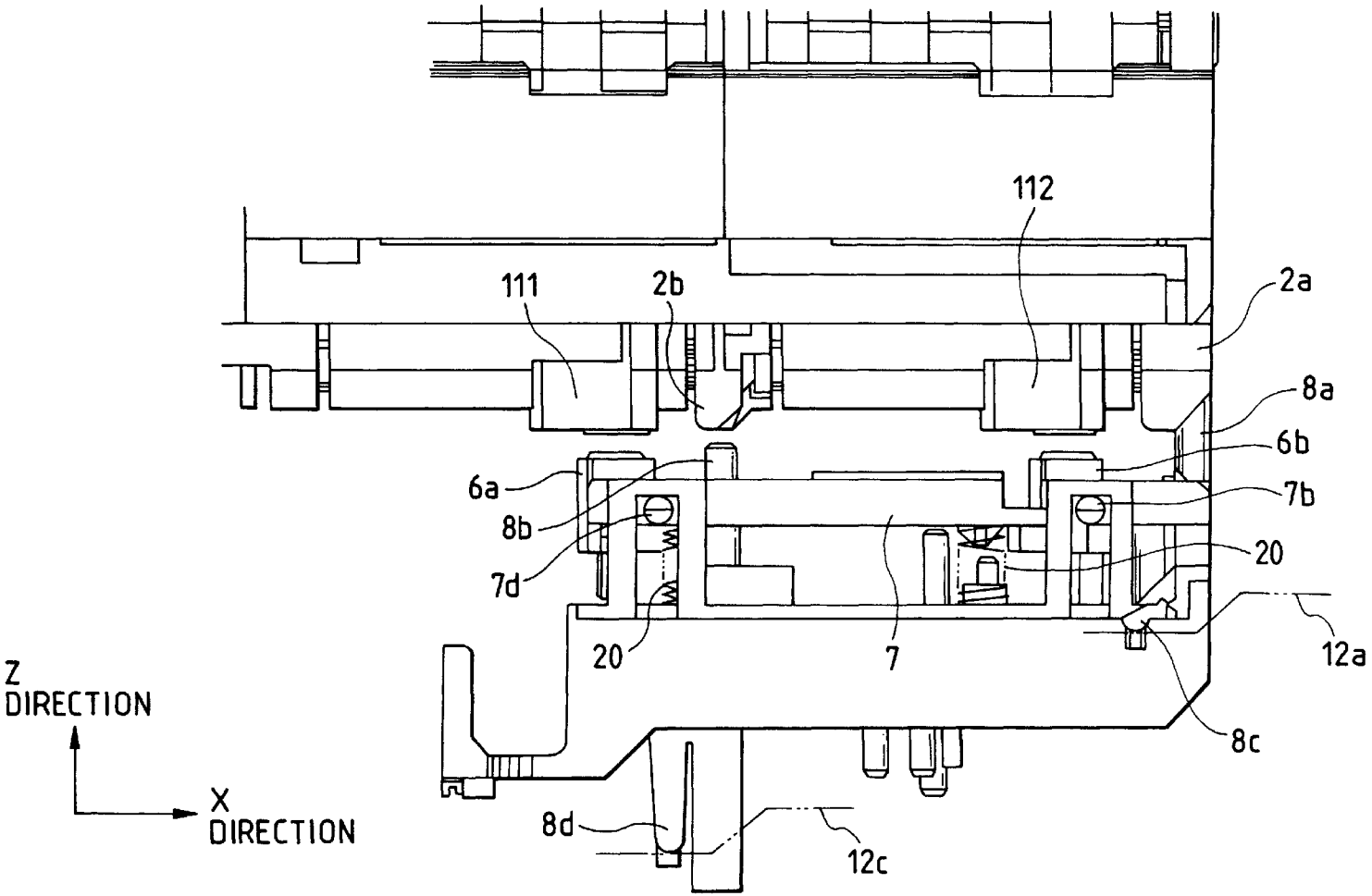
FIG. 11 is a side view of the carriage located on the slide cap mechanism of the ink jet recording apparatus in the first embodiment of the present invention.
Figure 12:
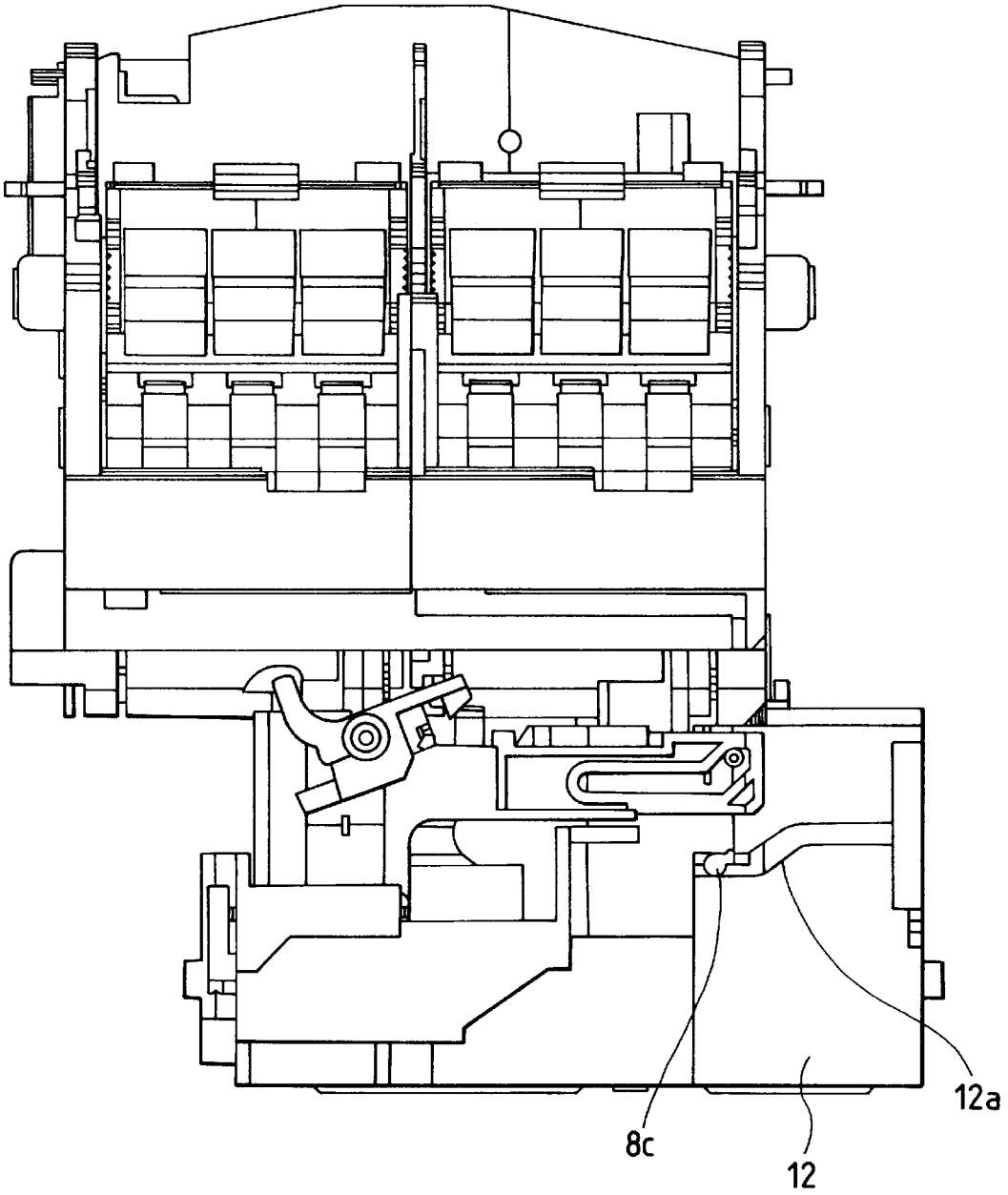
FIG. 12 is a side view of the carriage located on the slide cap mechanism of the ink jet recording apparatus in the first embodiment of the present invention.

Constructions around the caps 6*a*, 6*b* will next be explained. As shown in FIG. 4, each of the caps 6*a*, 6*b* is held by a cap holder 7. The cap holder 7 is held by a cap slider 8 through each of cap springs 20 (see FIGS. 11, 13). The cap springs 20 are arranged in every two places approximately just below the caps 6*a*, 6*b* on rear sides of their openings.

As shown in FIGS. 6 and 7, two holes are respectively formed in the caps 6*a*, 6*b*. One hole is connected to the suction tubes 10*a*, 10*b* and the other hole is connected to atmospheric communicating tubes 9*a*, 9*b*.

The other end of each of the atmospheric communicating tubes 9*a*, 9*b* is inserted into the cap slider 8 and a valve 17 is arranged at a tip of this inserted end through a packing 17*a*. When the cap slider 8 is slid, this valve 17 is closed in a position (2) of FIG. 9 and is opened in a position (1).

A capping operation will next be explained with reference to FIGS. 2 to 15.

When a printing operation is terminated, the carriage 2 is moved in the direction of an arrow A2 shown in FIG. 3. A first positioning member (X) 8*a* of the cap slider 8 comes in contact with a fitting portion 2*a* of the carriage 2 (see FIGS. 2, 10 and 11). At this time, a clearance is formed in a vertical direction with respect to the recording paper toward (Z-direction) the recording head in a capping position such that no second positioning member (Y) 8*b* interferes with the fitting portion 2*a* of the carriage 2 (see FIGS. 4, 5 and 11). Further, the positioning member (Y) 8*b* is set such that no positioning member (Y) 8*b* interferes with the recording head.

Figure 10:
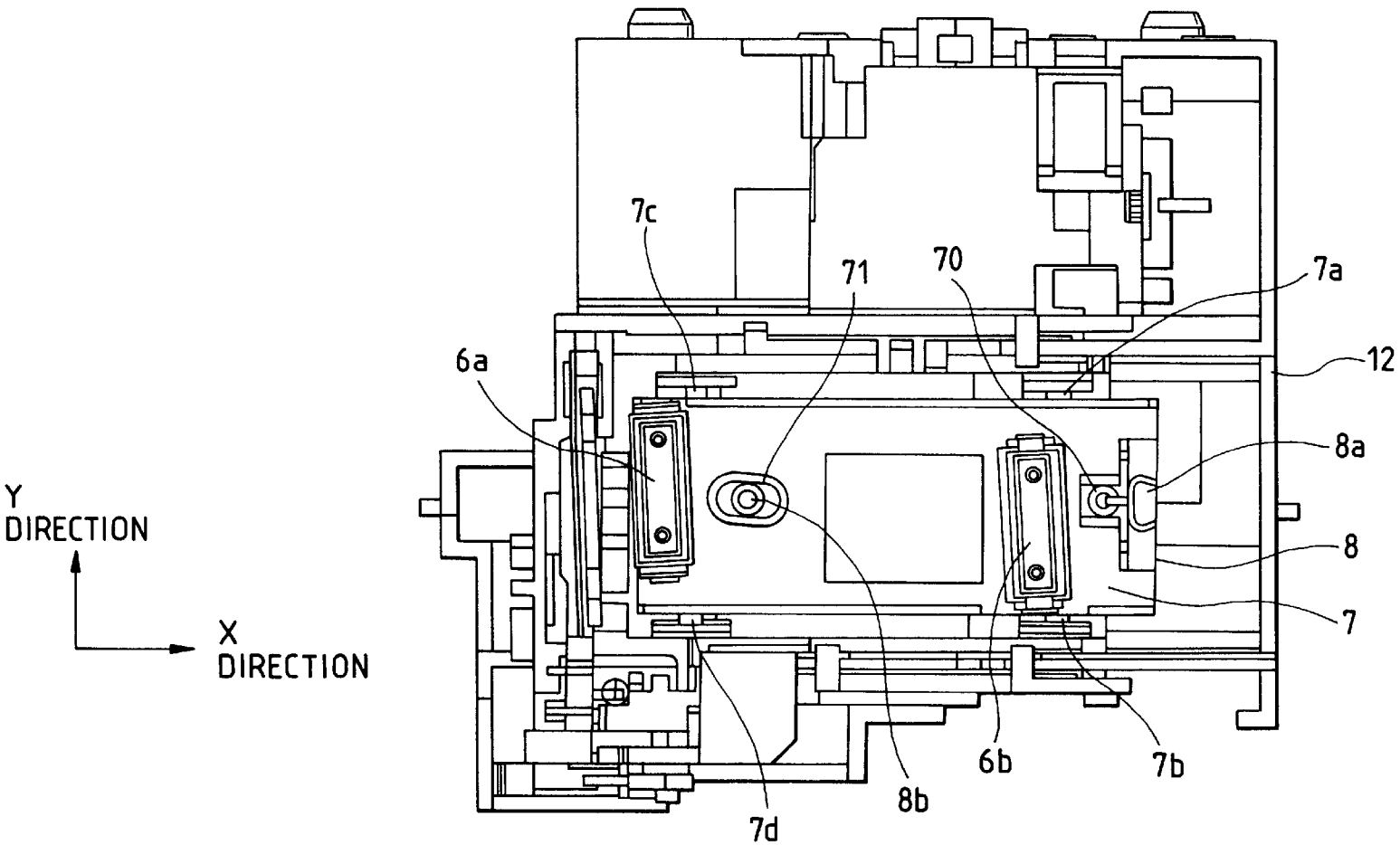
FIG. 10 is a plan view showing the slide cap mechanism of the ink jet recording apparatus in the first embodiment of the present invention.
Figure 13:
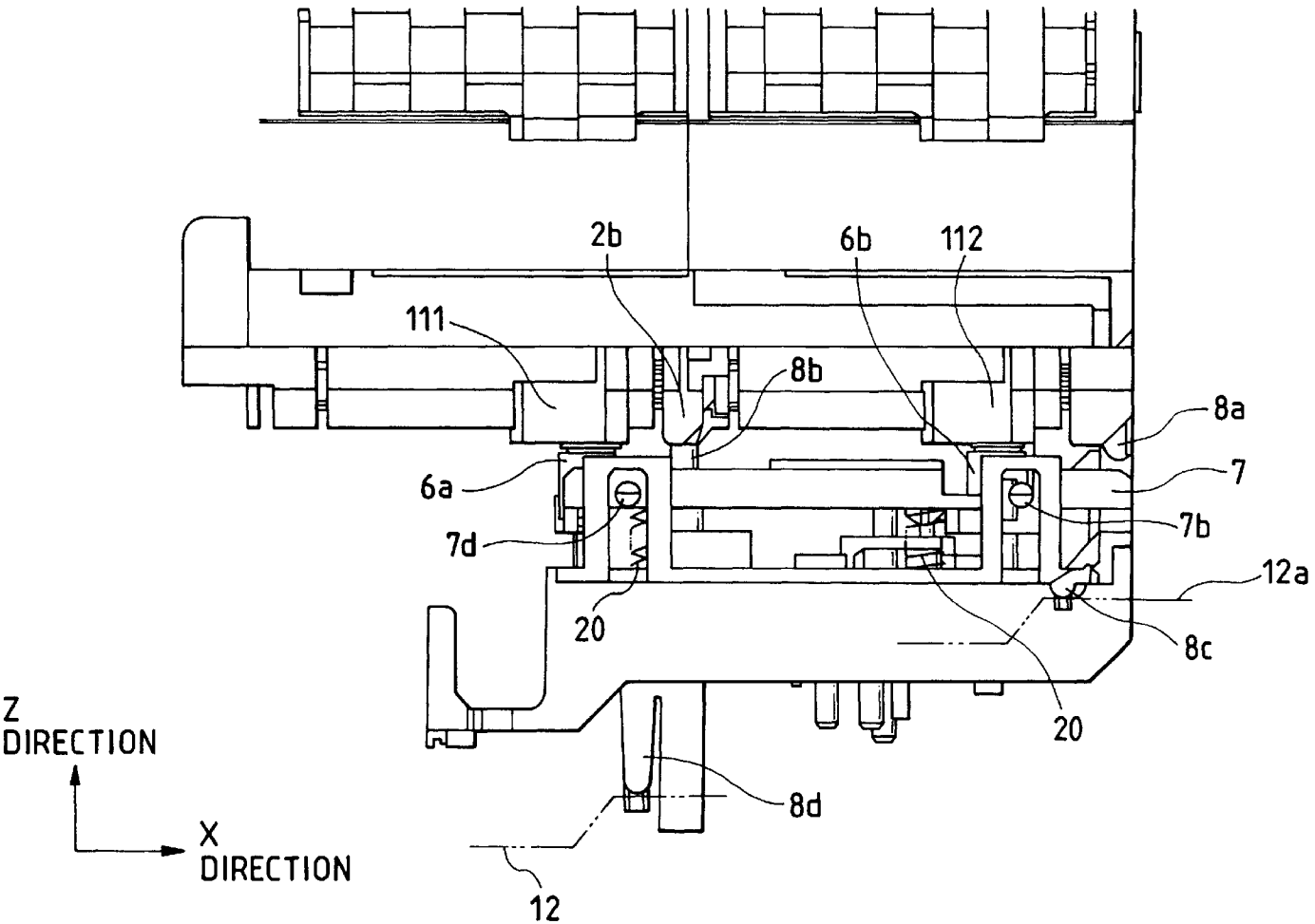
FIG. 13 is a side view of a cap of the slide cap mechanism of the ink jet recording apparatus in the first embodiment of the present invention when the cap comes in contact with a head of the carriage.
Figure 14:
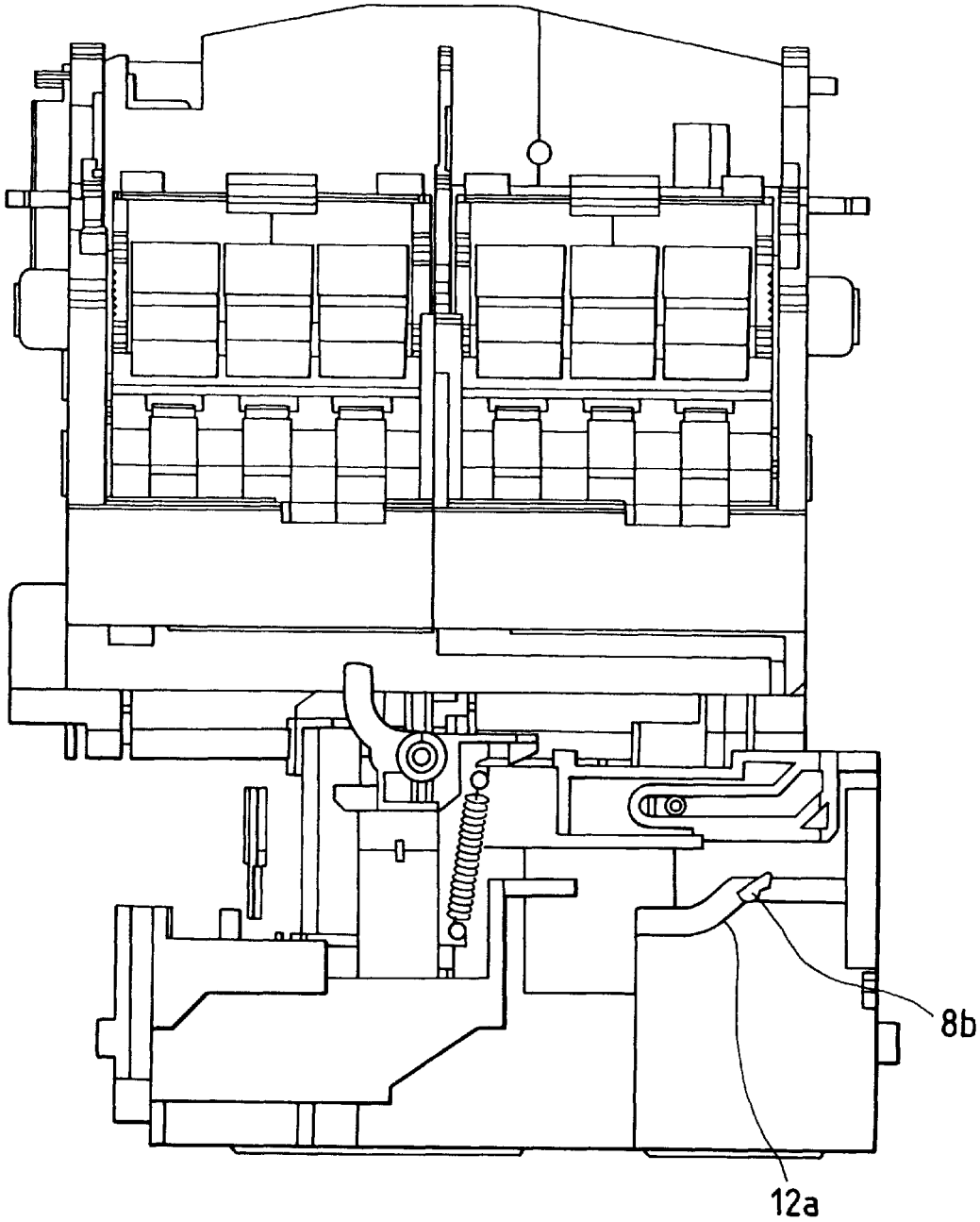
FIG. 14 is a side view of the cap of the slide cap mechanism of the ink jet recording apparatus in the first embodiment of the present invention when the cap comes in contact with the head of the carriage.
Figure 15:
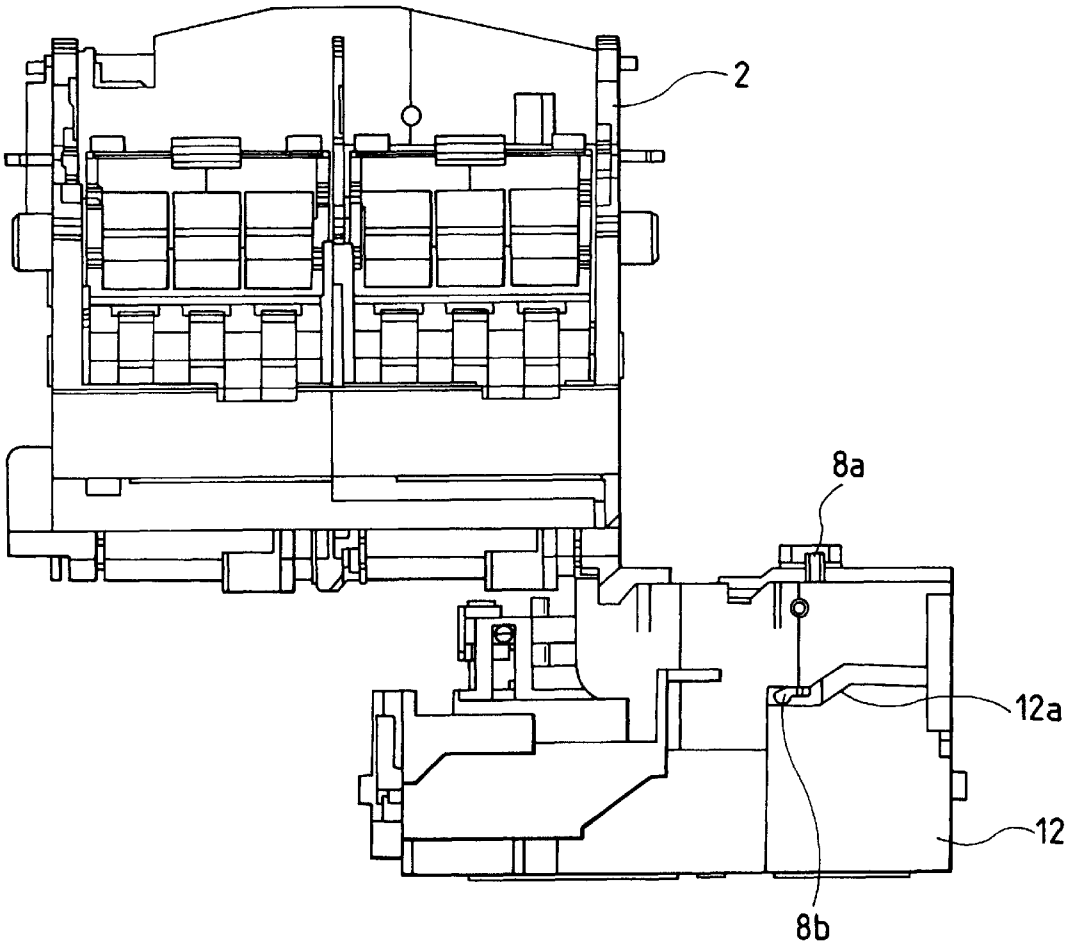
FIG. 15 is a side view of the carriage of the ink jet recording apparatus in the first embodiment of the present invention when the carriage is located in a printing position.

Further, when the carriage 2 is moved in the direction of the arrow A2 in FIG. 3, a boss portion 8*c* (and 8*d*) of the cap slider 8 is moved upward along a cam face 12*a* (and 12*c*) of the restoring base 12. Accordingly, the cap slider 8 is pushed upward in the Z-direction (see FIGS. 13 and 14). At this time, as shown in FIG. 13, the positioning member (Y) 8*b* of the cap slider 8 is fitted to a middle wall 2*b* of the carriage 2. Namely, in the capping position (the carriage position shown in each of FIGS. 13 and 14), the carriage 2 and the positioning member (X) 8*a* of the cap slider 8 come in contact with each other and perform a positioning operation in the X-direction. The fitting portion 2*a* of the carriage 2 and the positioning member (X) 8*a* of the cap slider 8 are fitted to each other. Further, the wall 2*b* of the carriage 2 and the positioning member (Y) 8*b* of the cap slider 8 are fitted to each other. Thus, the positioning operation in the Y-direction (e.g., the conveying direction of the recording medium different from the X-direction and the Z-direction) is performed. Further, as shown in FIG. 10, the cap slider 8 and the cap holder 7 are positioned in the X-direction by fitting the cap sliders and one boss 7*a* of four bosses 7*a*, 7*b*, 7*c* and 7*d* arranged in the cap holder 7. The cap slider 8 and the cap holder 7 are positioned in the Y-direction by fitting the positioning members 8*a*, 8*b* of the cap slider 8 to fitting portions 70 and 71 of the cap slider 7.

As mentioned above, the cap slider 8 and the carriage 2 are fitted to each other and the cap slider 8 and the cap holder 7 are fitted to each other in each of the X-direction and the Y-direction. Accordingly, plural recording heads mounted to the carriage 2 and plural caps 6 mounted to the cap holder 7 can be reliably positioned with high accuracy.

Second embodiment

Figure 16:
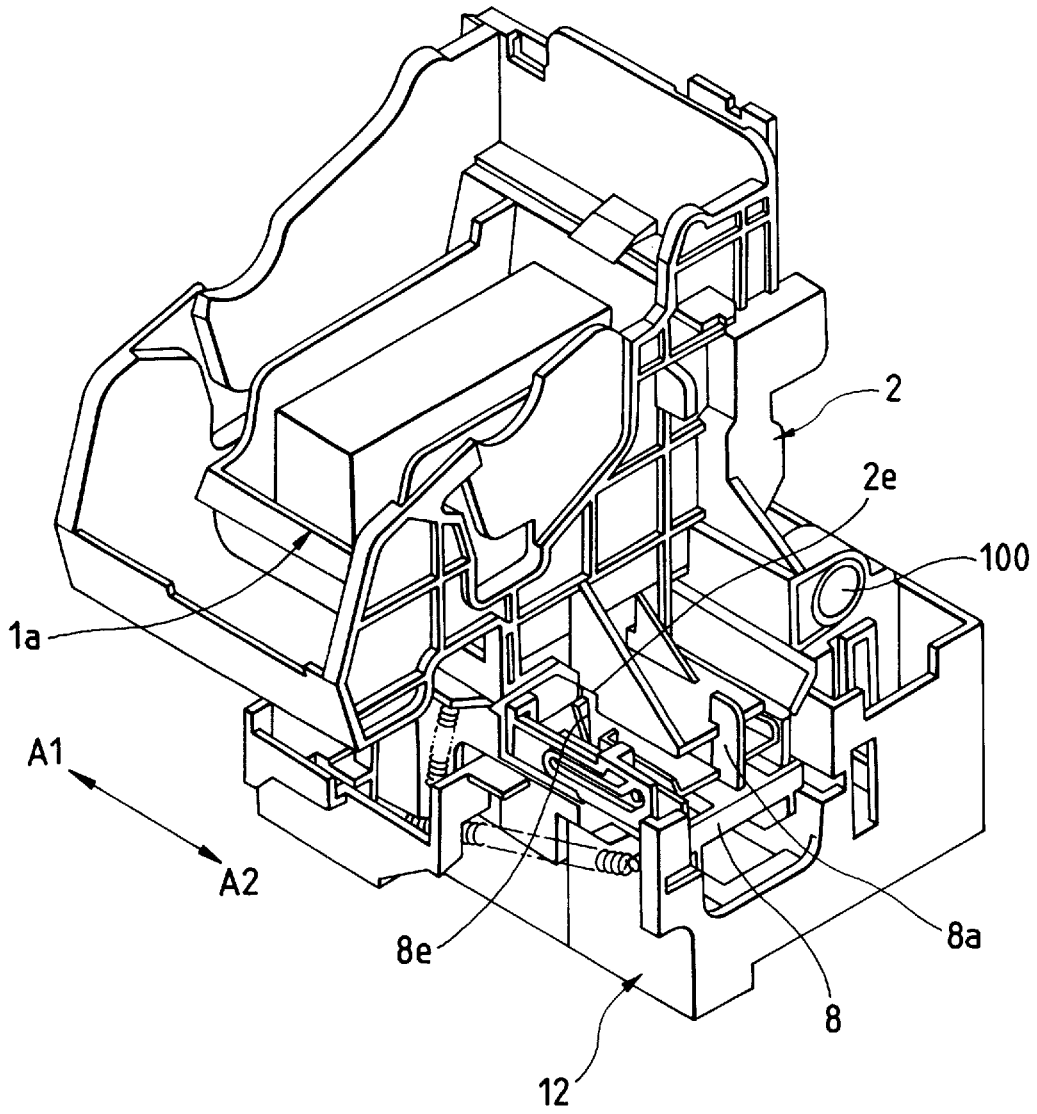
FIG. 16 is a perspective view showing a carriage and a slide cap mechanism in an ink jet recording apparatus in a second embodiment of the present invention.
Figure 17:
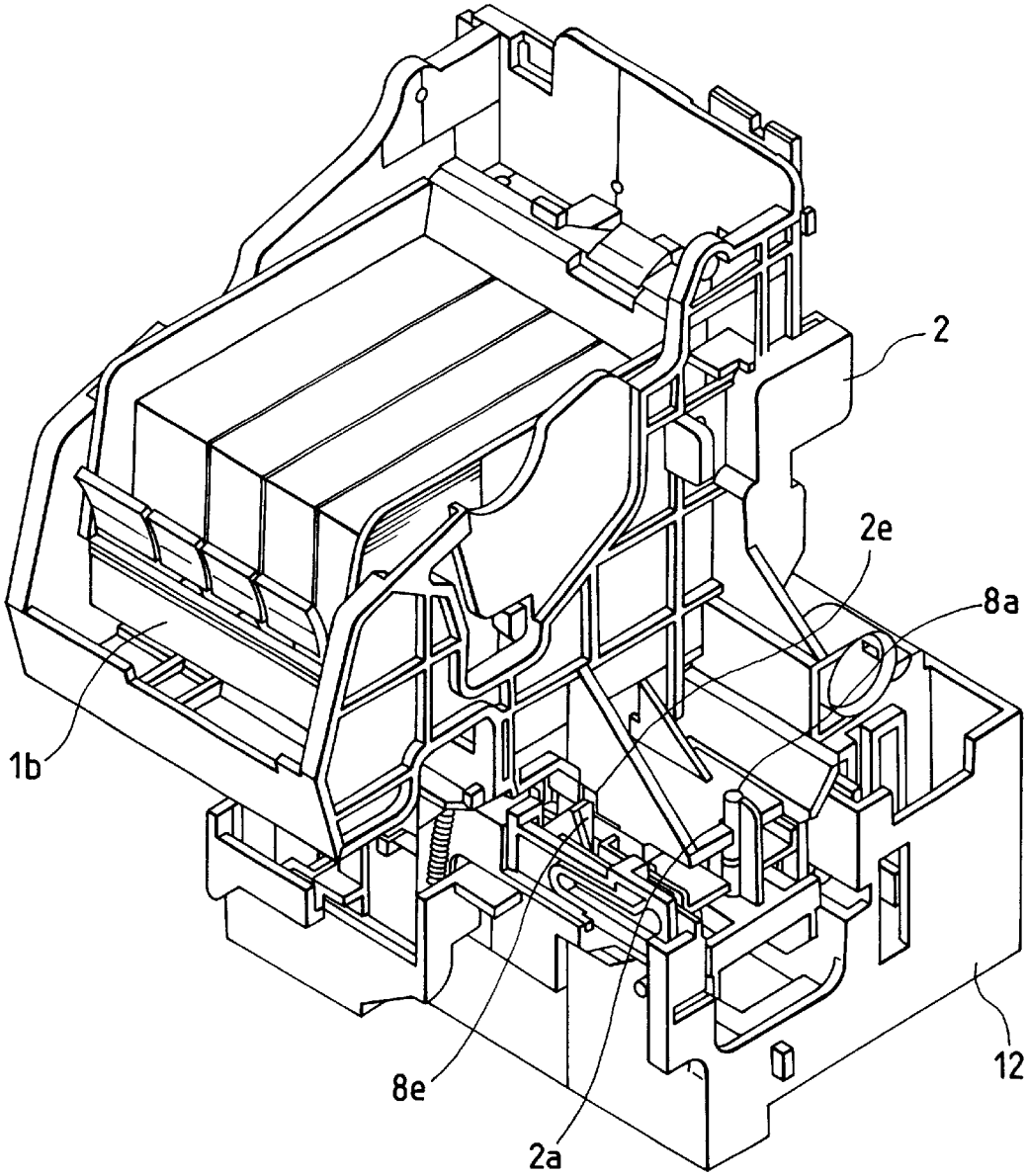
FIG. 17 is a perspective view showing the carriage and the slide cap mechanism in the ink jet recording apparatus in the second embodiment of the present invention.
Figure 18:
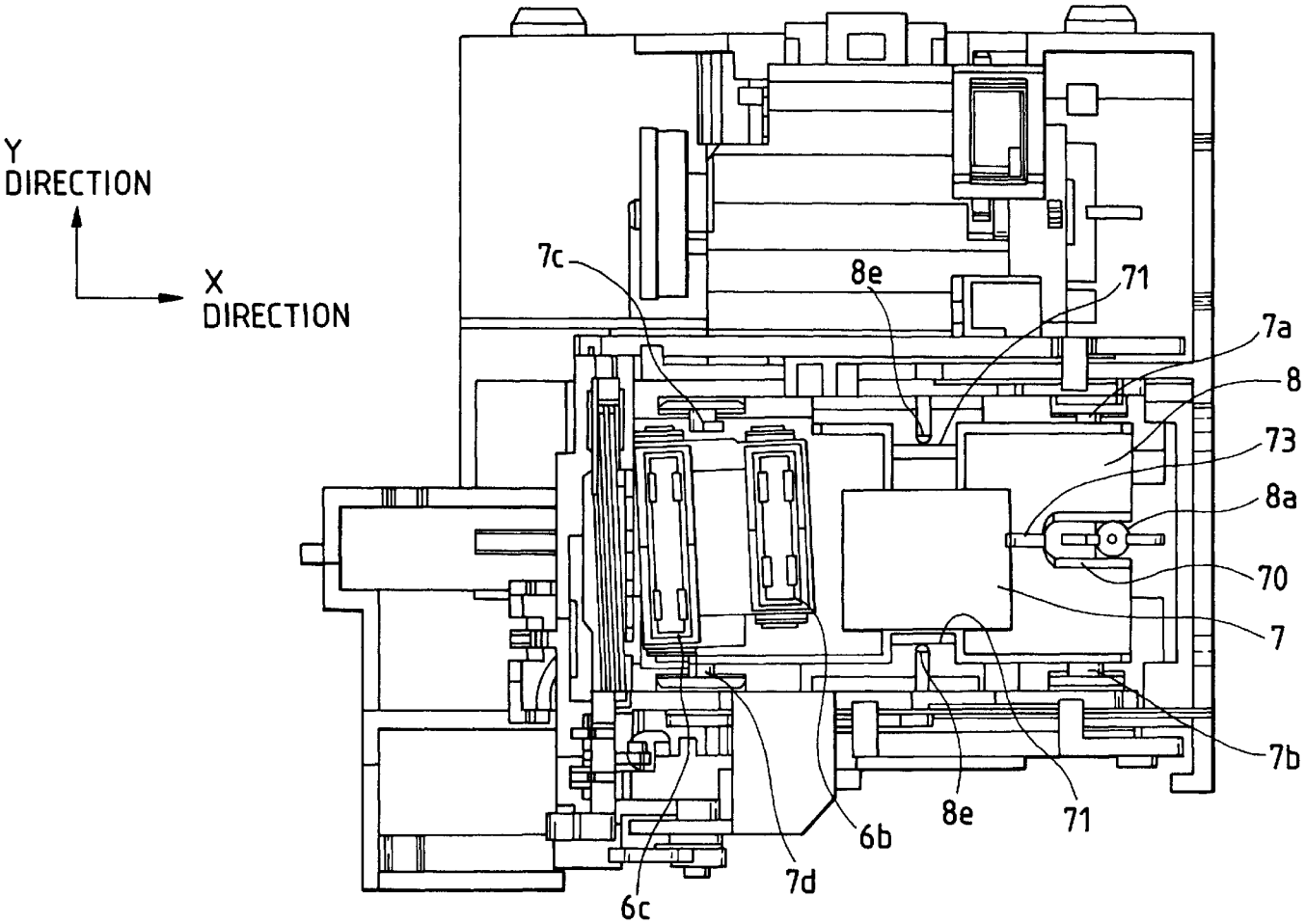
FIG. 18 is a plan view showing the slide cap mechanism of the ink jet recording apparatus in the second embodiment of the present invention.

FIGS. 16 to 18 particularly show perspective views of a slide cap mechanism of an ink jet recording apparatus in a second embodiment of the present invention. In these figures, a carriage 2 is freely moved along a guide shaft 101 in a direction different from the conveying direction of a sheet of recording paper, e.g., in a main scanning direction perpendicular to the conveying direction. The carriage 2 is mounted by inserting the guide shaft 101 into a hole 100 of a carriage rear portion. The carriage 2 is constructed such that two heads of different kinds can be mounted to the carriage 2. These two heads are suitably exchanged by a user in accordance with a recording object. For example, in FIG. 16, a black head la having only a black tank is mounted to the carriage 2. This case is suitable for the execution of recording of a text at high speed. As shown in FIG. 17, the black head can be replaced with a head 1*b* having yellow, magenta, cyan and black ink tanks with respect to the carriage 2. This case is suitable for a printing operation of a business color. When the head is replaced with a photohead having tanks of magenta and cyan thin in density and yellow and black ink tanks, it is possible to construct a recorder suitable for a printing operation of an image of high quality at a photograph level.

When such a head can be mounted to the carriage 2, the number of nozzles of the black head la is set to e.g., about 160 in consideration of high speed printing. In the color head or the photohead of the head 1*b*, 48 yellow nozzles, 48 magenta nozzles, 48 cyan nozzles and 48 black nozzles are most advantageous in view of a printing speed. At this time, 48×3 in a total nozzle number of this head+ undischarging nozzles as spaces between the respective colors are required. Accordingly, the black head la and a forming face of an ink discharging port of the head cannot be formed in the same shape.

Therefore, the cap of the head 1*b* is set to a cap 6*c* (hereinafter called a big cap) having a size corresponding to the head 1*b*. Accordingly, there are the cap 6*b* and the big cap 6*c* in the cap holder 7 so as to change the caps used in accordance with the mounted head.

A pump used at this time is the same as the first embodiment. A sucking cap can be selected in accordance with a rotating direction of the pump. For example, when the pump is rotated in the direction of an arrow a in FIG. 6, an internal pressure of the cap 6*b* communicated with the suction tube 10*a* becomes negative so that the head 1*a* (see FIGS. 20 and 21) capped by the cap 6*b* can be sucked. When the pump is rotated in the direction of an arrow b in FIG. 7, an internal pressure of the big cap 6*c* communicated with the suction tube 10*b* becomes negative so that the head 1*b* (see FIGS. 22 and 23) capped by the big cap 6*c* can be sucked.

A carriage lock 15 is frictionally operated such that the carriage lock 15 attains a lock state at a normal rotating time of the suction pump 11 (in the direction of an arrow b in FIG. 8) and attains an unlock state at a reverse rotating time (in the direction of an arrow a in FIG. 8).

Figure 19:
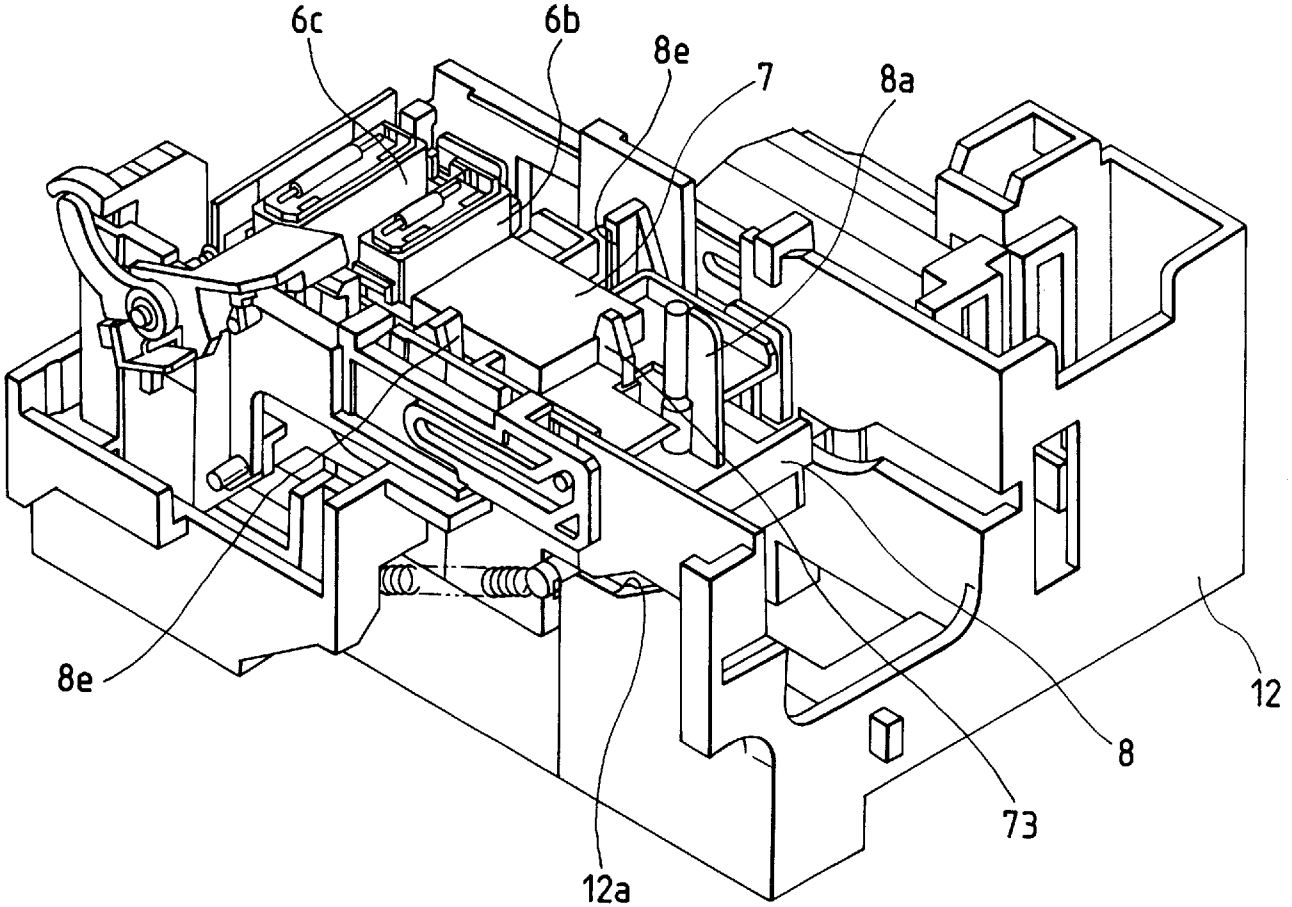
FIG. 19 is a perspective view showing the slide cap mechanism of the ink jet recording apparatus in the second embodiment of the present invention.
Figure 20:
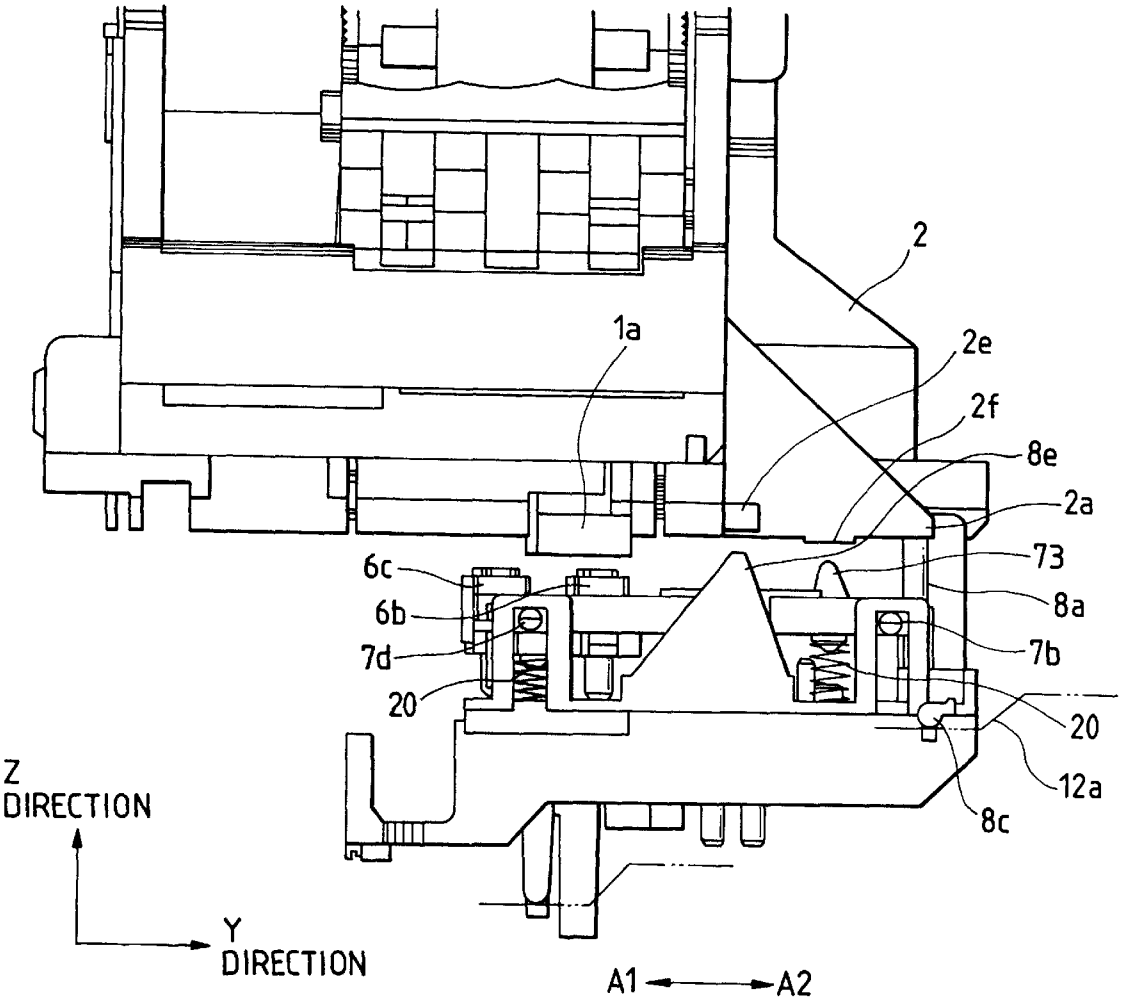
FIG. 20 is a side view of the carriage mounting a black head thereto when the carriage is located on the slide cap mechanism of the ink jet recording apparatus in the second embodiment of the present invention.
Figure 21:
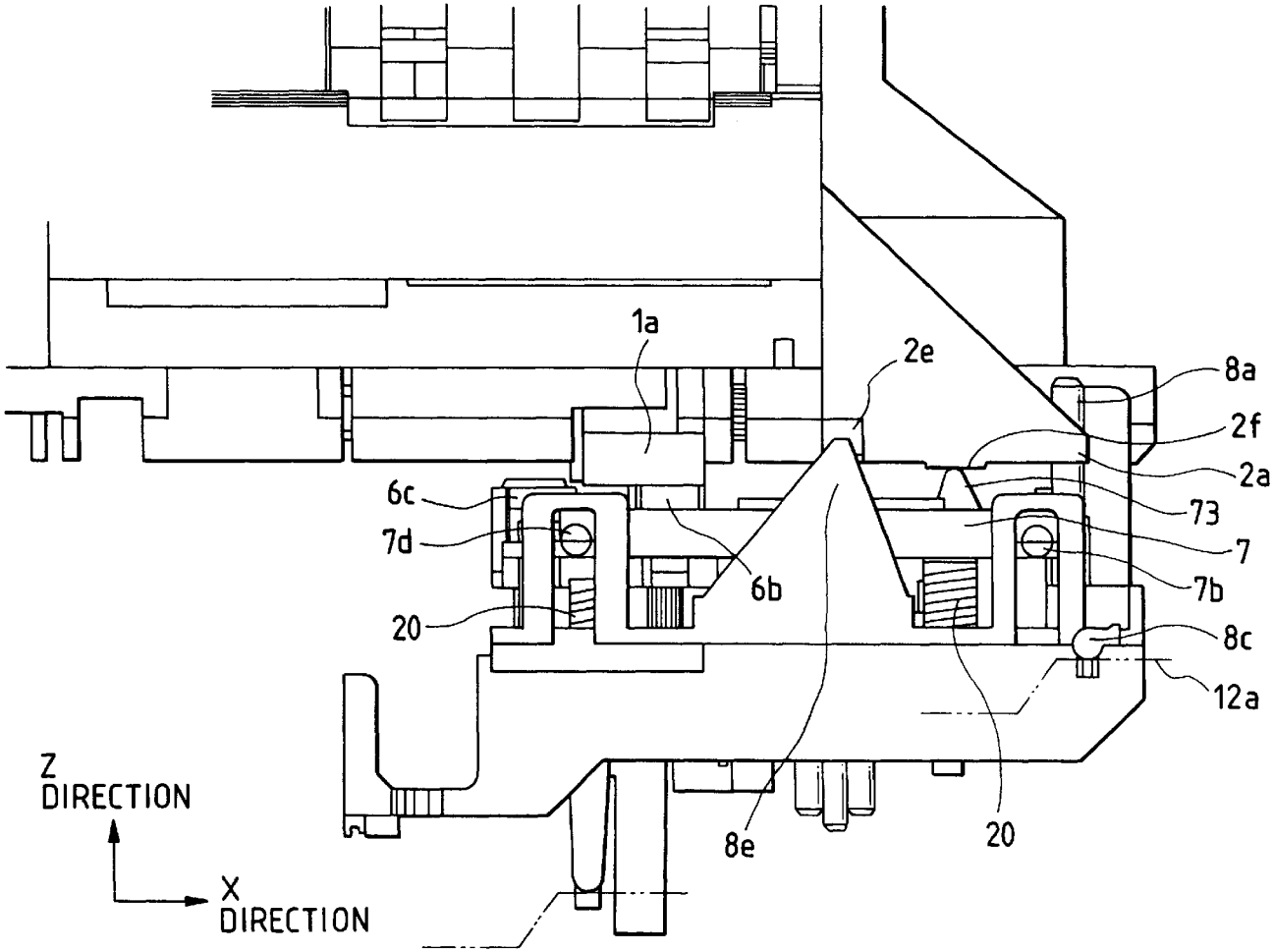
FIG. 21 is a side view of a cap of the slide cap mechanism of the ink jet recording apparatus in the second embodiment of the present invention when the cap comes in contact with the black head of the carriage.

Next, constructions around the cap 6*b* and the big cap 6*c* will be explained. As shown in FIGS. 18 and 19, the cap 6*b* and the big cap 6*c* are held by a cap holder 7. The cap holder 7 is held by a cap slider 8 through each of cap springs 20 (see FIGS. 20 and 21). As shown in FIGS. 20 and 21, the cap springs 20 are arranged in two places at a center of the clearance in the X-direction between the cap 6*b* and the big cap 6*c* or approximately this center (central portion), and are also arranged in two places just below or approximately just below a third positioning member (Z) 73 on its rear side.

As shown in FIGS. 6 and 7, two holes are formed in each of the cap 6*b* and the big cap 6*c*. One hole is connected to the suction tubes 10*a*, 10*b* and the other hole is connected to atmospheric communicating tubes 9*a*, 9*b*.

The other end of each of the atmospheric communicating tubes 9*a*, 9*b* is inserted into the cap slider 8 and a valve 17 is arranged at a tip of this inserted end through a packing 17*a*. When the cap slider 8 is slid, this valve 17 is closed in a position (2) of FIG. 9 and is opened in a position (1).

A capping operation will next be explained with reference to FIGS. 16 to 23.

When a printing operation is terminated, the carriage 2 is moved in the direction of an arrow A2 shown in FIG. 16. A first positioning member (X) 8*a* of the cap slider 8 comes in contact with a fitting portion 2*a* of the carriage 2 (see FIGS. 16, 17, 20 and 22). At this time, a clearance is formed in a vertical direction with respect to the recording paper toward (Z-direction) the recording head in a capping position such that no second positioning member (Y) 8*e* interferes with the fitting portion 2*a* of the carriage 2 (see FIGS. 20 and 22). Further, the positioning member (Y) 8*e* is set such that no positioning member (Y) 8*e* interferes with the recording head.

FIG. 20 shows a position relation of the head 1*a* and the cap 6*b* when the black head 1*a* is mounted to the carriage 2. When the carriage 2 is further moved in the direction of the arrow A2, a boss portion 8*c* of the cap slider 8 is moved upward along a cam face 12*a* of a restoring base 12 so that the cap slider 8 is pushed upward in the Z-direction (see FIG. 21). At this time, as shown in FIG. 21, the positioning member (Y) 8*e* of the cap slider 8 is fitted to the positioning portion 2*e* of the carriage 2. Further, a third positioning member (Z) 73 of the cap holder 7 hits against a Z-direction positioning portion 2*f* of the carriage 2 and the cap 6*b* is pressed against the head 1*a* so that capping is completed.

Figure 22:
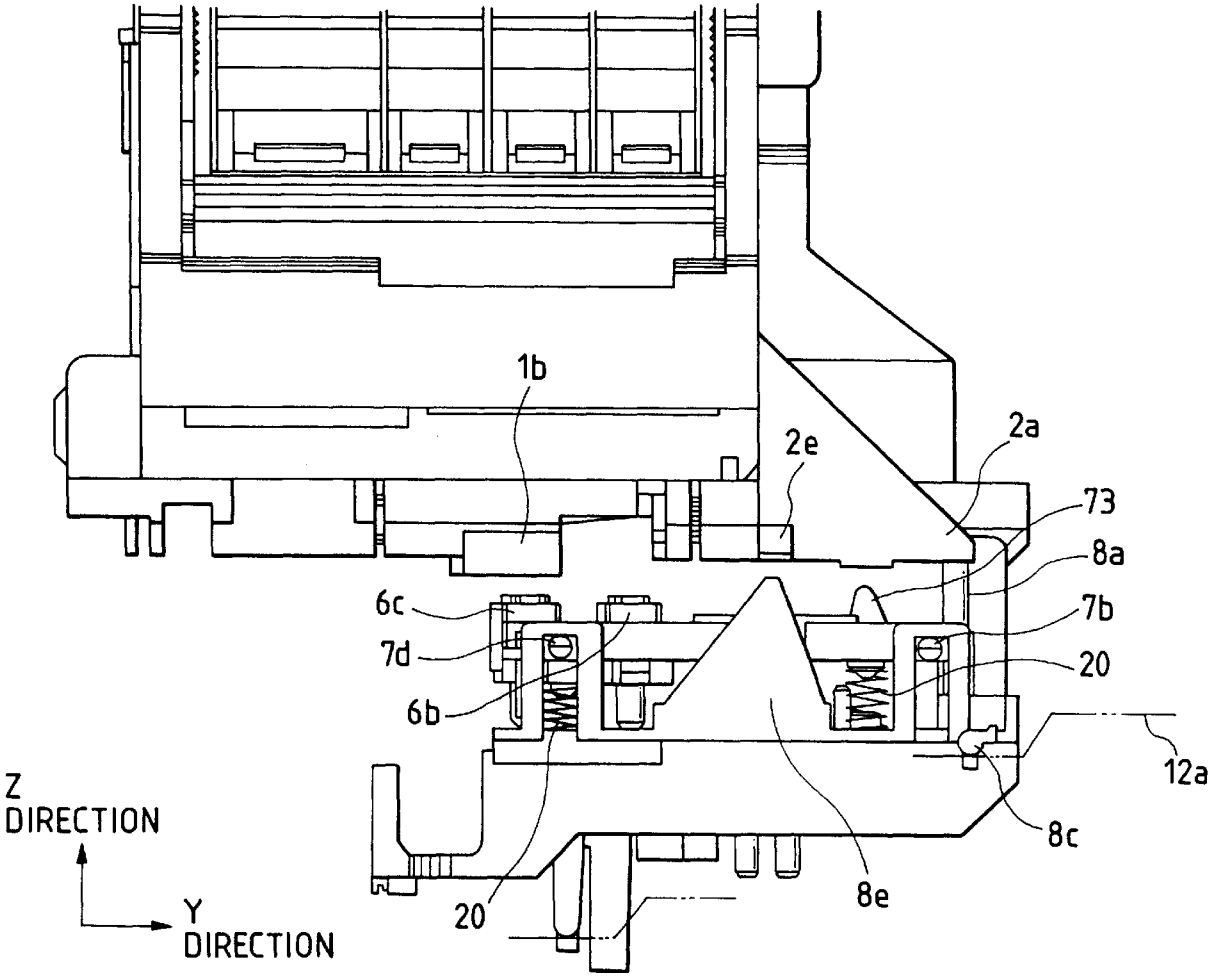
FIG. 22 is a side view of the carriage mounting a color head or a photohead thereto when the carriage is located on the slide cap mechanism of the ink jet recording apparatus in the second embodiment of the present invention.

FIG. 22 shows a position relation of the head 1*b*and the big cap 6*c* when the color head (or photohead) 1*b* is mounted to the carriage 2. FIG. 23 shows a capping state at the mounting time of the photohead 1*b*. Namely, in the capping position (the position of FIG. 23), the carriage 2 and the positioning member (X) 8*a* of the cap slider 8 come in contact with each other and perform a positioning operation in the X-direction. The fitting portion 2*a* of the carriage 2 and the positioning member (X) 8*a* of the cap slider 8 are fitted to each other, and the positioning portion 2*e* of the carriage 2 and the positioning member (Y) 8*e* of the cap slider 8 are fitted to each other so that the positioning operation is performed in the Y-direction. Further, as shown in FIG. 18, the cap slider 8 and the cap holder 7 are positioned in the X-direction by fitting the cap slider 8 and one boss 7*a* of four bosses 7*a*, 7*b*, 7*c* and 7*d* arranged in the cap holder 7. The cap slider 8 and the cap holder 7 are positioned in the Y-direction by fitting the positioning members 8*a* and 8*e* of the cap slider 8 to fitting portions 70 and 71 of the cap holder 7.

As mentioned above, the cap slider 8 and the carriage 2 are fitted to each other and the cap slider 8 and the cap holder 7 are fitted to each other with respect to each of the X-direction, the Y-direction and the Z-direction. Accordingly, the heads of two kinds mounted to the carriage 2 and the plural caps 6 mounted to the cap holder 7 can be reliably positioned with high accuracy.

Other embodiments

In the ink jet recording apparatus of each of the first and second embodiments explained above, two ink jet recording heads having a single ink discharging port series are mounted to the carriage and each ink discharging port series is capped by a corresponding cap. However, the present invention is also applied when one ink jet recording head is mounted to the carriage and is capped by one cap. In this case, the ink discharging port series is reliably covered and an ink discharging port forming face can be sealed. This is because, when a relative position accuracy of the carriage and the cap holder is slightly reduced in such a form, an error in this position is adjusted by resilient biasing of a cap spring and the ink discharging port series can be capped.

When the ink jet recording head having plural ink discharging port series is mounted to the carriage, the present invention is also applied in an ink jet recording apparatus in which the plural ink discharging port series are covered with a single cap. In this case, these ink discharging port series can be reliably covered and ink discharging port forming faces can be sealed. This is because a cap spring for biasing the cap holder can be arranged in the cap slider in such a form so as to resiliently bias plural suitable positions corresponding to a rear side of the cap in consideration of mutual facing positions of the cap and the plural ink discharging port series to be capped.

In the above first and second embodiments, the plural caps 6*a*, 6*b* are held by one cap holder 7 in the ink jet recording apparatus. However, the present invention is also applied in an ink jet recording apparatus in which plural cap holders are arranged in the cap slider and plural caps are suitably dispersed and arranged in any one of the cap holders. In this case, these ink discharging port series can be reliably covered and ink discharging port forming faces can be sealed. In such a form, the plural caps can be resiliently biased independently of the other cap holders every cap holder in comparison with a case in which the plural caps are held by a single cap holder and are resiliently biased. Accordingly, the position relation can be adjusted by the individual cap holders even when the accuracy of the relative position of the carriage and the cap slider is slightly reduced.

In a most preferable form, a single cap with respect to a single ink discharging port series is held by a separate cap holder every cap and each of the cap holders is resiliently biased on a head side independently of the other cap holders even when the number of ink jet recording heads mounted to the carriage is one or plural.

In each of the embodiments explained above, when the carriage is moved from a printing position to the capping position, the carriage hits against the first positioning member of the cap slider as a constructional element of the slide cap mechanism in the capping position, and the cap slider is slid. The cap slider is moved to the capping position by this slide, but is moved by a cam face toward the head in the capping position. Thus, the cap held by the cap holder on the cap slider comes in contact with the recording head of the carriage and is pressed by a spring below the cap holder.

In accordance with the above construction, in processes for moving the carriage from the printing position to the capping position and pressing the cap against the head, the cap slider and the carriage are fitted to each other and the cap slider and the cap holder are fitted to each other by the first and second positioning members in each of the X-direction and the Y-direction. Accordingly, the head mounted to the carriage and the cap held by the cap holder can be positioned by a simple construction with high accuracy.

In the embodiments explained above, the ink jet recording apparatus of the slide cap mechanism able to simultaneously mount plural heads to the carriage has plural caps for protecting the respective heads, a cap holder for holding the plural caps, and a cap slider for holding the cap holder. The above cap holder and the above cap slider are fitted to each other in a scanning direction (hereinafter, the X-direction) of the carriage. A positioning member (X) hitting against the carriage in the X-direction is arranged in the above cap slider. This positioning member (X) is fitted to the cap holder and positions the cap holder and the cap slider in a conveying direction (hereinafter, the Y-direction) of the recording paper. Further, a separate positioning member (Y) is arranged in the above cap slider. This positioning member (Y) is fitted to the cap holder and positions the cap slider and the cap holder in the Y-direction. The positioning member (Y) is also fitted to the carriage in the capping position and positions the carriage and the cap. Accordingly, the caps can be positioned by a simple construction with high accuracy.

In the ink jet recording apparatus of the slide cap mechanism able to exchange the heads mounted to the carriage, a positioning member (Z) hitting against the carriage in the Z-direction is arranged in the cap holder. A lower portion of the positioning member (Z) is pressurized by a spring and is pressed against the carriage. Further, a central portion between two caps according to the recording heads is pressurized by a spring and these caps are pressed against the recording heads. Accordingly, the caps can be positioned by a simple construction with high accuracy.

Further, as mentioned above, a reassembling operation can be simply performed as two kinds of recorders having different functions only by constructing a cap unit corresponding to a carriage able to mount two heads, or constructing a cap unit corresponding to a carriage able to exchange two heads. Accordingly, the other parts in the above two kinds of recorders can be set to common parts so that cost can be reduced.

What is claimed is:

1. An ink jet recording apparatus having a carriage which mounts an ink jet recording head for discharging ink through an ink discharge port and having conveying means for conveying a recording medium, the carriage moving between a recording position where said carriage is opposed to the recording medium and a capping position where said carriage is opposed to a cap for covering said ink discharge port, said ink jet recording apparatus comprising:

a cap holder for holding said cap for covering said ink discharge port;

a cap slider for movably holding said cap holder for elastically biasing said cap toward said ink jet recording head at said capping position and moving in the same direction as a moving direction of said carriage in association with the movement of said carriage upon the movement of said carriage to said capping position;

a first positioning member provided on said cap slider to position said cap slider to said carriage, said first positioning member positioning said cap slider in a first direction which is a moving direction of said carriage and positioning said cap slider in a second direction which is a conveyance direction of the recording medium; and a second positioning member provided on said cap slider to position said cap slider to said carriage, said second positioning member positioning said cap slider in said second direction.

2. An apparatus according to claim 1, wherein said cap slider has an elastic member which biases said cap toward said ink jet recording head at said capping position.

3. An apparatus according to claim 1, wherein said carriage mounts a plurality of ink jet recording heads and said cap means has a plurality of caps each for covering each said ink discharge port of said ink jet recording head.

4. An apparatus according to claim 3, wherein said cap slider has elastic members which elastically bias each of said caps independently from other said caps toward said ink jet recording heads at said capping position.

5. An apparatus according to claim 1, further comprising a slider holding mechanism which includes a cam mechanism for displacing said cap slider to a side of said ink jet recording head at said capping position.

6. An apparatus according to claim 1, wherein said carriage and said first positioning member are fitted into each other so as to perform positioning in said first direction and said carriage and said second positioning member are fitted into each other so as to establish positioning in said second direction.

7. A capping method for an ink jet recording apparatus having a carriage which mounts an ink jet recording head for discharging ink through an ink discharge port and having conveying means for conveying a recording medium, the carriage moving between a recording position where said carriage is opposed to the recording medium and a capping position where said carriage is opposed to a cap for covering said ink discharge port, said method comprising:

providing a cap holder for holding said cap for covering said ink discharge port;

providing a cap slider for movably holding said cap holder for elastically biasing said cap toward said ink jet recording head at said capping position;

moving said cap slider in the same direction as a moving direction of said carriage in association with the movement of said carriage upon the movement of said carriage to said capping position;

providing a first positioning member provided on said cap slider to position said cap slider to said carriage, and by said first positioning member positioning said cap slider in a first direction which is a moving direction of said carriage and positioning said cap slider in a second direction which is a conveyance direction of the recording medium; and providing a second positioning member provided on said cap slider to position said cap slider to said carriage, and by said second positioning member positioning said cap slider in said second direction, following positioning of said cap slider by said first positioning member.

* * * * *

UNITED STATES PATENT AND TRADEMARK OFFICE

CERTIFICATE OF CORRECTION

PATENT NO. : 6,390,592 B2
DATED : May 21, 2002
INVENTOR(S) : Okamura

It is certified that error appears in the above-identified patent and that said Letters Patent is hereby corrected as shown below:

Column 3,
Line 66, “jet.” should read -- jet --.

Column 7,
Line 1, “sliders” should read -- slider 8 --; and
Lines 26, 38 and 45, “la” should read -- 1a --.

Column 8,
Line 47, “1band” should read -- 1b and --.

Signed and Sealed this

Eighteenth Day of February, 2003

JAMES E. ROGAN
*Director of the United States Patent and Trademark Office*